US011155995B2

(12) United States Patent
Crosby

(10) Patent No.: US 11,155,995 B2
(45) Date of Patent: Oct. 26, 2021

(54) CONCRETE FORM WITH REMOVABLE SIDEWALL

(71) Applicant: Airlite Plastics Co., Omaha, NE (US)

(72) Inventor: Bradley J. Crosby, Omaha, NE (US)

(73) Assignee: Airlite Plastics Co., Omaha, NE (US)

( * ) Notice: Subject to any disclaimer, the term of this patent is extended or adjusted under 35 U.S.C. 154(b) by 0 days.

(21) Appl. No.: 16/688,388

(22) Filed: Nov. 19, 2019

(65) Prior Publication Data

US 2020/0157807 A1 May 21, 2020

Related U.S. Application Data

(60) Provisional application No. 62/769,109, filed on Nov. 19, 2018.

(51) Int. Cl.
*E04B 2/86* (2006.01)
*E04G 17/065* (2006.01)
(Continued)

(52) U.S. Cl.
CPC ..... *E04B 2/8647* (2013.01); *E04B 2/8611* (2013.01); *E04B 2/8635* (2013.01);
(Continued)

(58) Field of Classification Search
CPC ..... E04G 15/04; E04G 11/06; E04G 11/08; E04G 17/02; E04G 17/04; E04G 17/042;
(Continued)

(56) References Cited

U.S. PATENT DOCUMENTS 221,110 A 10/1879 Shellenback et al.
858,933 A * 7/1907 White ..... E04B 2/84 52/378
(Continued)

FOREIGN PATENT DOCUMENTS

AT 10642 U2 * 7/2009 ..... E04B 2/8635
AU 664029 B2 11/1995
(Continued)

OTHER PUBLICATIONS

Portland Cement Association, Prescriptive Design of Exterior Concrete Walls for One- and Two-Family Dwellings (2008), 123 pages.
(Continued)

*Primary Examiner* — Michael Safavi
(74) *Attorney, Agent, or Firm* — Banner & Witcoff, Ltd.

(57) ABSTRACT

A concrete form includes a first sidewall and a second sidewall positioned in parallel and spaced relation to each other, where the first sidewall has a first passage extending therethrough, with a first insert received in the first passage of the first sidewall. The form also includes a first cross tie having opposed first and second ends, where the first sidewall is removably secured to the first end of the first cross tie and the second sidewall is secured to the second end of the first cross tie. A first fastener extends through the first passage and engages the first insert and the first end of the first cross tie to removably secure the first sidewall to the first cross tie. The second sidewall may be removably or non-removably secured to the first cross tie.

25 Claims, 15 Drawing Sheets

(51) Int. Cl.
*E04G 17/02* (2006.01)
*E04G 15/04* (2006.01)

(52) U.S. Cl.
CPC ..... *E04G 15/04* (2013.01); *E04G 17/02* (2013.01); *E04G 17/0655* (2013.01); *E04B 2002/8682* (2013.01)

(58) Field of Classification Search
CPC ..... E04G 17/047; E04G 17/0654; E04G 17/0655; E04B 2/8611; E04B 2002/8682; E04B 2/8635; E04B 2/8647; E04B 2/8617; E04B 2/8623; E04B 2/86; E04B 2/847
USPC .... 249/33, 192; 52/426, 442, 428, 378, 379, 52/562, 565, 568, 508
See application file for complete search history.

(56) References Cited

U.S. PATENT DOCUMENTS 1,694,665 A 12/1928 Parker
1,796,973 A 3/1931 Wright
1,836,408 A 12/1931 Sutton
1,895,801 A 1/1933 Keller
1,983,040 A 12/1934 Lyons
2,073,788 A 3/1937 Garvey et al.
2,177,246 A 10/1939 Ellis
2,201,110 A 5/1940 Makram
2,452,463 A 10/1948 Herbert
2,498,276 A 2/1950 Kany
3,255,562 A 6/1966 Altschuler
3,374,917 A 3/1968 Troy
3,383,817 A 5/1968 Gregori
3,422,588 A 1/1969 Stewart, Jr.
3,552,076 A 1/1971 Gregori
3,740,909 A 6/1973 Stinnes
3,751,867 A 8/1973 Layne
3,788,020 A 1/1974 Gregori
3,791,090 A 2/1974 Kniefel
3,835,608 A 9/1974 Johnson
3,895,469 A 7/1975 Kapitan
3,924,376 A 12/1975 Tsurumi
3,936,987 A 2/1976 Calvin
3,959,944 A 6/1976 Oroschakoff
3,968,615 A 7/1976 Ivany
3,992,844 A 11/1976 Gretter
4,021,989 A 5/1977 Hala
4,022,644 A 5/1977 Smith, Jr.
4,031,678 A 6/1977 Schuring
4,034,529 A 7/1977 Lampus
4,041,670 A 8/1977 Kaplan
4,060,952 A 12/1977 Hernandez
4,090,337 A 5/1978 Szekeres
4,107,895 A 8/1978 LeGrady
4,133,156 A 1/1979 Unger
4,147,322 A 4/1979 Dahlstrom
4,185,423 A 1/1980 Gutierrez
4,223,501 A 9/1980 DeLozier
4,226,061 A 10/1980 Day, Jr.
4,229,920 A 10/1980 Lount
4,234,156 A 11/1980 Wepf
4,240,233 A 12/1980 Vercelletto
4,247,073 A 1/1981 Vario
4,263,765 A 4/1981 Maloney
4,320,888 A 3/1982 Oury
4,321,779 A 3/1982 Kratchmer
4,348,847 A 9/1982 Jukes
4,366,657 A 1/1983 Hopman
4,402,167 A 9/1983 Denucci
4,406,103 A 9/1983 Ghali et al.
4,407,102 A 10/1983 Boyack
4,411,118 A 10/1983 Claver
4,433,520 A 2/1984 Maschhoff
4,433,521 A 2/1984 Dietrich
4,433,522 A 2/1984 Yerushalmi
4,438,612 A 3/1984 Bernard et al.
4,439,967 A 4/1984 Dielenberg
4,442,644 A 4/1984 Jukes
4,471,590 A 9/1984 Roberts et al.
4,479,338 A 10/1984 Robertson
4,516,372 A 5/1985 Grutsch
4,551,870 A 11/1985 Presti, Jr.
4,557,093 A 12/1985 Beliveau
4,557,094 A 12/1985 Beliveau
4,571,909 A 2/1986 Berghuis et al.
4,577,447 A 3/1986 Doran
4,598,519 A 7/1986 Reid
4,599,830 A 7/1986 Nawrot
4,604,843 A 8/1986 Ott et al.
4,628,652 A 12/1986 Wefels
4,629,192 A 12/1986 Nichols
4,632,796 A 12/1986 Moulet
4,648,228 A 3/1987 Kiselewski
4,655,014 A 4/1987 Krecke
4,669,234 A 6/1987 Wilnau
4,698,947 A 10/1987 McKay
4,700,523 A 10/1987 Kohara
4,706,429 A 11/1987 Young
4,730,422 A 3/1988 Young
4,731,968 A 3/1988 Obino
4,742,659 A 5/1988 Meilleur
4,750,307 A 6/1988 Slager
4,750,308 A 6/1988 McKay
4,765,109 A 8/1988 Boeshart
4,773,199 A 9/1988 Kohara
4,788,020 A 11/1988 Yampolsky et al.
4,791,767 A 12/1988 Boeshart
4,811,927 A 3/1989 Slonimsky et al.
4,817,353 A 4/1989 Woods et al.
4,825,618 A 5/1989 Blevins
4,835,928 A 6/1989 Scott
4,852,317 A 8/1989 Schiavello et al.
4,860,515 A 8/1989 Browning, Jr.
4,862,660 A 9/1989 Raymond
4,864,792 A 9/1989 Andre et al.
4,866,891 A 9/1989 Young
4,879,855 A 11/1989 Berrenberg
4,883,396 A 11/1989 Shamah et al.
4,884,382 A 12/1989 Horobin
4,885,888 A 12/1989 Young
4,888,931 A 12/1989 Meilleur
4,889,310 A 12/1989 Boeshart
4,894,969 A 1/1990 Horobin
4,901,494 A 2/1990 Miller et al.
4,916,879 A 4/1990 Boeshart
4,936,540 A 6/1990 Boeshart
4,938,449 A 7/1990 Boeshart
4,949,515 A 8/1990 Krecke
4,967,528 A 11/1990 Doran
4,972,646 A 11/1990 Miller et al.
4,974,388 A 12/1990 Fischer
4,976,081 A 12/1990 Litzenberger
4,998,394 A 3/1991 Holzapfel et al.
5,014,480 A 5/1991 Guarriello et al.
5,024,035 A 6/1991 Hanson et al.
5,060,446 A 10/1991 Beliveau
5,065,561 A * 11/1991 Mason ..... E04B 2/8641 52/309.12
5,086,600 A 2/1992 Holland et al.
5,092,093 A 3/1992 Lu
5,097,644 A 3/1992 Hun
5,099,628 A 3/1992 Noland et al.
5,099,630 A 3/1992 Bolmgren
5,107,648 A 4/1992 Roby
5,117,600 A 6/1992 Yerushalmi
5,122,015 A 6/1992 Shen
5,123,222 A 6/1992 Guarriello et al.
5,140,794 A 8/1992 Miller
5,163,261 A 11/1992 O'Neill
5,174,083 A 12/1992 Mussell
D335,542 S 5/1993 Bird
5,212,842 A 5/1993 Glydon
5,215,490 A 6/1993 Szoradi

(56) References Cited

U.S. PATENT DOCUMENTS

D343,426 S 1/1994 Sher
D343,427 S 1/1994 Sher
5,323,578 A 6/1994 Chagnon et al.
5,332,189 A 7/1994 Tseng
5,337,530 A 8/1994 Beames
5,350,256 A 9/1994 Hammer
5,351,455 A 10/1994 Schoonover et al.
5,351,456 A 10/1994 Paine, Jr.
5,390,459 A 2/1995 Mensen
5,428,933 A 7/1995 Philippe
5,454,199 A 10/1995 Blom et al.
5,459,970 A 10/1995 Kim
5,459,971 A 10/1995 Sparkman
5,465,542 A 11/1995 Terry
5,473,850 A 12/1995 Balding
5,491,949 A 2/1996 De Moor
5,497,592 A * 3/1996 Boeshart ..... E04B 2/8647 249/43
D370,503 S 6/1996 Burns
5,535,565 A 7/1996 Majnaric et al.
5,537,797 A * 7/1996 Harkenrider ..... E04G 9/05 52/745.13
5,553,430 A 9/1996 Majnaric et al.
5,566,518 A 10/1996 Martin et al.
5,566,519 A 10/1996 Almaraz-Miera
5,566,521 A 10/1996 Andrews et al.
5,568,710 A 10/1996 Smith et al.
5,570,552 A 11/1996 Nehring
5,596,855 A 1/1997 Batch
5,598,675 A 2/1997 Pruss
5,608,999 A 3/1997 McNamara et al.
5,611,182 A 3/1997 Spude
5,611,183 A 3/1997 Kim
5,617,693 A 4/1997 Hefner
5,625,989 A * 5/1997 Brubaker ..... E04B 2/54 249/40
5,632,126 A 5/1997 Agsten
5,638,652 A 6/1997 Shinoda et al.
5,649,401 A 7/1997 Harrington, Jr.
5,653,082 A 8/1997 Shinoda et al.
5,657,600 A 8/1997 Mensen
5,657,601 A 8/1997 Bean et al.
5,658,483 A 8/1997 Boeshart
5,678,369 A 10/1997 Ishikawa et al.
5,688,078 A 11/1997 Hammer
5,692,356 A 12/1997 Baxter
5,695,676 A 12/1997 Lee
5,699,640 A 12/1997 Bourgeois et al.
5,701,710 A 12/1997 Tremelling
5,704,180 A 1/1998 Boeck
5,709,060 A 1/1998 Vaughan et al.
5,709,061 A 1/1998 Dietrich
5,735,093 A 4/1998 Grutsch
5,740,648 A 4/1998 Piccone
5,761,874 A 6/1998 Hayakawa
5,768,851 A 6/1998 Nagaoka
5,782,050 A 7/1998 Boeshart
5,802,793 A 9/1998 DeVore, Jr.
5,802,795 A 9/1998 Myers et al.
5,803,669 A 9/1998 Bullard
5,809,723 A 9/1998 Keith et al.
5,809,725 A 9/1998 Cretti
5,809,726 A 9/1998 Spude
5,809,727 A 9/1998 Mensen
5,809,728 A 9/1998 Tremelling
5,818,997 A 10/1998 Fasanella et al.
5,819,489 A 10/1998 McKinney
5,836,126 A 11/1998 Harkenrider et al.
5,839,243 A 11/1998 Martin
5,845,445 A 12/1998 Blackbeard
5,845,449 A 12/1998 Vaughan et al.
5,845,455 A 12/1998 Johnson, III
5,852,907 A 12/1998 Tobin et al.
5,853,314 A 12/1998 Bora
5,857,300 A 1/1999 Gates
5,860,262 A 1/1999 Johnson
5,861,105 A 1/1999 Martineau
5,881,524 A 3/1999 Ellison, Jr.
5,887,401 A 3/1999 Moore, Jr.
5,890,337 A 4/1999 Boeshart
5,893,248 A 4/1999 Beliveau
5,895,188 A 4/1999 Cheng
5,896,714 A 4/1999 Cymbala et al.
5,918,427 A 7/1999 VanderWerf
5,930,958 A 8/1999 Stanley
5,930,970 A 8/1999 De Le fevre
5,937,604 A 8/1999 Bowron
5,945,448 A 8/1999 Ninomiya et al.
5,987,830 A 11/1999 Worley
5,992,114 A 11/1999 Zelinsky et al.
6,000,184 A 12/1999 Fernandes
6,070,380 A 6/2000 Meilleur
6,085,476 A 7/2000 Jantzi et al.
6,112,491 A 9/2000 Keith et al.
6,122,880 A 9/2000 Kolb et al.
6,131,360 A 10/2000 Dalen
6,148,576 A 11/2000 Janopaul, Jr.
6,151,856 A 11/2000 Shimonohara
6,151,857 A 11/2000 Raschke
6,167,671 B1 1/2001 Wilson
6,170,220 B1 1/2001 Moore, Jr.
6,173,937 B1 1/2001 Cottongim
6,176,059 B1 1/2001 Cantarano et al.
6,178,711 B1 * 1/2001 Laird ..... E04B 2/8635 52/357
6,219,984 B1 4/2001 Piccone
6,224,031 B1 5/2001 Boeshart
6,226,951 B1 5/2001 Azar
6,230,462 B1 * 5/2001 Beliveau ..... E04B 2/8617 52/426
6,231,024 B1 5/2001 Kugimiya et al.
6,231,025 B1 5/2001 Takemura
6,233,897 B1 5/2001 Jurik
6,240,692 B1 6/2001 Yost et al.
6,250,024 B1 6/2001 Sculthorpe et al.
6,250,033 B1 6/2001 Zelinsky
6,252,523 B1 6/2001 Mostrom
6,253,518 B1 7/2001 Azar
6,253,519 B1 7/2001 Daniel
6,253,523 B1 7/2001 McKinnon
6,263,631 B1 7/2001 Nisbett et al.
6,276,104 B1 8/2001 Long, Sr. et al.
6,276,549 B1 8/2001 Fasci et al.
6,279,285 B1 8/2001 Kubica
6,279,287 B1 8/2001 Meadows
6,293,059 B1 9/2001 Goodwin
6,293,067 B1 9/2001 Meendering
6,293,068 B1 9/2001 Harrington, Jr.
6,301,851 B1 10/2001 Matsubara
6,308,484 B1 10/2001 Severino
6,314,694 B1 * 11/2001 Cooper ..... E04B 2/8611 249/190
6,314,697 B1 11/2001 Moore, Jr.
6,318,040 B1 11/2001 Moore, Jr.
6,321,496 B1 11/2001 Martin, Jr.
6,321,497 B1 11/2001 Cormier
6,321,498 B1 11/2001 Trovato et al.
6,324,804 B1 12/2001 Hoogstraten
6,332,300 B1 12/2001 Wakai
6,336,301 B1 1/2002 Moore, Jr.
6,349,520 B2 2/2002 Kubica
6,352,237 B1 3/2002 Severino
6,360,505 B1 3/2002 Johns
6,363,683 B1 4/2002 Moore, Jr.
6,378,260 B1 4/2002 Williamson et al.
6,378,261 B1 4/2002 Agsten
6,401,413 B1 6/2002 Niemann
6,401,419 B1 6/2002 Beliveau
6,405,505 B1 6/2002 Alberti
6,412,231 B1 7/2002 Palatin
6,438,917 B2 8/2002 Kubica
6,438,918 B2 8/2002 Moore, Jr. et al.
6,474,033 B1 11/2002 Luchini et al.
6,481,178 B2 11/2002 Moore, Jr.

(56) References Cited

U.S. PATENT DOCUMENTS 6,519,906 B2 2/2003 Yost et al.
6,526,713 B2 3/2003 Moore, Jr.
6,536,172 B1 3/2003 Amend
6,568,141 B2 5/2003 Kremers
6,574,934 B1 6/2003 Queirel
6,578,333 B1 6/2003 Gagliano
6,609,340 B2 8/2003 Moore, Jr. et al.
6,612,083 B1 * 9/2003 Richards ..... E04B 1/161 52/127.12
6,647,686 B2 11/2003 Dunn et al.
6,665,992 B2 12/2003 Hew
6,668,502 B2 12/2003 Beliveau
6,668,503 B2 12/2003 Beliveau
6,681,539 B2 1/2004 Yost et al.
6,688,066 B1 2/2004 Cottier et al.
6,691,481 B2 2/2004 Schmidt
6,761,007 B2 7/2004 Lancelot, III et al.
6,792,729 B2 * 9/2004 Beliveau ..... E04B 2/8617 52/279
6,820,384 B1 11/2004 Pfeiffer
6,832,456 B1 * 12/2004 Bilowol ..... E04G 9/02 249/190
6,898,912 B2 5/2005 Bravinski
6,945,506 B2 9/2005 Long, Sr.
6,948,289 B2 9/2005 Bravinski
7,059,577 B1 6/2006 Burgett
7,082,731 B2 8/2006 Patz et al.
7,082,732 B2 * 8/2006 Titishov ..... E04B 2/8617 52/426
7,124,547 B2 10/2006 Bravinski
7,266,931 B2 9/2007 Long, Sr.
7,818,935 B2 10/2010 Velickovic
7,934,693 B2 * 5/2011 Bravinski ..... E04B 2/8647 249/216
8,037,652 B2 10/2011 Marshall et al.
8,348,222 B2 1/2013 Lin
8,495,846 B2 7/2013 Bravinski
8,555,583 B2 10/2013 Ciuperca
8,555,584 B2 10/2013 Ciuperca
8,567,750 B2 10/2013 Amend
8,613,174 B2 12/2013 Garrett
8,635,826 B2 1/2014 Pfeiffer
8,646,236 B2 * 2/2014 Hilliard, Sr. ..... E04B 2/8652 52/309.11
8,756,890 B2 6/2014 Ciuperca
8,887,465 B2 11/2014 Crosby et al.
8,919,067 B2 12/2014 Crosby et al.
8,959,862 B1 2/2015 Kreizinger
9,074,379 B2 7/2015 Ciuperca
9,115,491 B2 8/2015 Keith et al.
9,157,233 B2 * 10/2015 Gosain ..... E04B 2/8641
9,458,637 B2 10/2016 Ciuperca
2003/0168575 A1 9/2003 Fearn et al.
2004/0055237 A1 * 3/2004 Bravinski ..... E04B 2/8647 52/426
2004/0103609 A1 * 6/2004 Wostal ..... E04B 2/8617 52/426
2005/0204679 A1 9/2005 Pfeiffer
2005/0223669 A1 10/2005 Cymbala et al.
2006/0010831 A1 1/2006 Skakie
2006/0117693 A1 6/2006 Garrett
2006/0213140 A1 9/2006 Morin et al.
2009/0057530 A1 * 3/2009 Sheckter ..... E04B 2/8647 249/18
2009/0120027 A1 5/2009 Amend
2009/0179135 A1 * 7/2009 Amend ..... E04G 17/06 249/33
2009/0308011 A1 12/2009 Philippe
2011/0057090 A1 3/2011 Spude et al.
2012/0131870 A1 * 5/2012 deMaere ..... E04B 2/8635 52/309.4
2013/0014458 A1 1/2013 Boydstun, IV et al.
2013/0180192 A1 * 7/2013 Crosby ..... E04B 2/8635 52/309.12
2013/0192156 A1 * 8/2013 Tims ..... E04B 2/26 52/404.2
2014/0308509 A1 10/2014 Gaddes et al.
2014/0319316 A1 10/2014 Bergman
2014/0333010 A1 11/2014 Ciuperca
2015/0167295 A1 * 6/2015 Baader ..... E04C 2/288 249/40
2017/0016237 A1 * 1/2017 Bombardier ..... E04G 11/08
2019/0257088 A1 * 8/2019 Ciuperca ..... E04B 5/36
2020/0063451 A1 * 2/2020 Amend ..... E04G 9/02

FOREIGN PATENT DOCUMENTS

AU 685614 C 12/2001
CA 256091 A 12/1925
CA 443900 A 9/1947
CA 2028992 C 4/1996
CA 2182055 C 5/1999
CA 2256261 A1 6/2000
CA 2257085 A1 * 6/2000 ..... E04B 2/8635
CA 2142517 C 4/2002
CA 2224949 C 8/2002
CA 2298435 C 11/2002
CA 2500682 C 9/2008
CA 2732490 A1 * 11/2011 ..... E04F 13/0837
CA 2492969 C 12/2012
CA 2980955 A1 * 10/2016 ..... E04B 2/8652
CA 2956649 A1 7/2017
CA 2956649 A1 * 7/2017 ..... E04G 17/14
CA 2985438 A1 * 5/2018 ..... E04G 15/04
CN 2142861 Y 9/1993
CN 2177759 Y 9/1994
CN 2213769 Y 11/1995
CN 2219338 Y 2/1996
CN 2232465 Y 8/1996
CN 2264219 Y 10/1997
CN 2265413 Y 10/1997
CN 2277430 Y 4/1998
CN 2291457 Y 9/1998
CN 2307851 Y 2/1999
CN 2315178 Y 4/1999
CN 2318290 Y 5/1999
CN 2326651 Y 6/1999
CN 2329720 Y 7/1999
CN 2330727 Y 7/1999
CN 2346856 Y 11/1999
CN 2360486 Y 1/2000
CN 1075183 C 11/2001
CN 1113283 C 7/2003
CN 1174922 C 11/2004
CN 1177390 C 11/2004
CN 1230237 C 12/2005
DE 2111730 A1 * 12/1972 ..... E04B 2/8611
DE 2111730 A1 12/1972
DE 2229113 A1 * 1/1974 ..... E04B 2/8647
DE 2255810 A1 * 5/1974 ..... E04B 2/8647
DE 3233470 A1 3/1984
DE 3315942 A1 11/1984
DE 3609780 A1 10/1986
DE 3609780 A1 * 10/1986 ..... E04B 2/8611
DE 4415406 A1 11/1995
DE 4434057 A1 3/1996
DE 29603330 U1 * 4/1996 ..... E04B 2/8611
DE 29605098 U1 * 8/1996 ..... E04B 2/8611
DE 19516134 A1 * 11/1996 ..... E04B 2/8635
DE 19520082 A1 * 12/1996 ..... E04B 2/8641
DE 29702609 U1 * 4/1997 ..... E04B 2/8635
DE 29711257 U1 * 8/1997 ..... E04B 2/8635
DE 102007005351 A1 * 8/2008 ..... E04B 2/8647
DE 102012205470 A1 * 6/2012 ..... E02D 27/02
DE 102014104722 A1 * 10/2015 ..... E04B 2/8611
DE 202015105866 U1 * 1/2016 ..... E04B 2/86
EP 540478 * 5/1993 ..... E04B 2002/8682
EP 540478 A1 5/1993
EP 1036891 A1 * 9/2000 ..... E04B 2/8635
EP 1749951 A1 * 2/2007 ..... E04H 4/0075
EP 2927383 A1 * 10/2015 ..... E04B 2/8647
EP 2789759 B1 * 4/2016 ..... E04B 2/8635
FR 2328814 A1 5/1977

(56) References Cited

FOREIGN PATENT DOCUMENTS

| | | | | | |
|---|---|---|---|---|---|
| FR | 2394647 | A1 | | 1/1979 | |
| FR | 2570416 | A1 | * | 3/1986 | ..... E04B 2/8611 |
| FR | 3006701 | A1 | * | 12/2014 | ..... E04G 17/14 |
| FR | 3019198 | | * | 10/2015 | ..... E04B 2/8647 |
| FR | 3006700 | B1 | * | 12/2015 | ..... E04G 17/0652 |
| GB | 190013282 | A | | 5/1901 | |
| GB | 113039 | A | * | 2/1918 | ..... E04B 2/8641 |
| GB | 113039 | A | | 2/1918 | |
| GB | 157638 | A | | 1/1921 | |
| GB | 162104 | A | | 4/1921 | |
| GB | 189481 | A | | 11/1922 | |
| GB | 296834 | A | | 9/1928 | |
| GB | 442286 | A | | 1/1936 | |
| GB | 142223 | A | | 2/1936 | |
| GB | 488640 | A | | 7/1938 | |
| GB | 508283 | A | | 6/1939 | |
| GB | 516873 | A | | 1/1940 | |
| GB | 517915 | A | | 2/1940 | |
| GB | 552692 | A | | 4/1943 | |
| GB | 600513 | A | | 4/1948 | |
| GB | 1385045 | A | | 2/1975 | |
| GB | 2162221 | A | | 1/1986 | |
| GB | 2170258 | A | | 7/1986 | |
| GB | 2240121 | A | | 7/1991 | |
| WO | 9512720 | A1 | | 5/1995 | |
| WO | 9905370 | A1 | | 2/1999 | |
| WO | 0233184 | A2 | | 4/2002 | |
| WO | WO-2011123526 | A2 | * | 10/2011 | ..... E04C 2/20 |
| WO | 2014138841 | A1 | | 9/2014 | |
| WO | WO-2016200131 | A1 | * | 12/2016 | ..... E04B 1/78 |
| WO | WO-2017171111 | A1 | * | 10/2017 | ..... E04B 2/8647 |
| ZA | 9702802 | B | | 10/1998 | |

OTHER PUBLICATIONS

NAHB Research Center, Inc., "Prescriptive Method for Insulating Concrete Forms in Residential Construction," May 1998, 100 pages.

NAHB Research Center, Inc., "Prescriptive Method for Insulating Concrete Forms in Residential Construction," Second Edition, Jan. 2002, 62 pages.

Pieter A. VanderWerf et al., Insulating Concrete Forms for Residential Design and Construction (McGraw-Hill 1997).

IntegraSpec "The User Friendly ICF" IntegraECF (Exposed Concrete Face), http://www.integraspec.com/documents/IntegraExposed2.pdf, Dec. 4, 2017.

One Sided Forms Against Shoring Wall, http://www.contractortalk.com/f84/one-sided-forms-against-shoring-wall-183250/index2/, Dec. 5, 2017.

Concrete Form Plywood, http://www.greatnorthernlumber.com/gnl/?page_id=978, Dec. 5, 2017.

High Density Overlay (HDO) Plyform, https://www.performancepanels.com/hdo-high-density-overlay-plyform, Dec. 5, 2017.

New Silk Concrete Wall, http://www.scottmagic.net/new-salk-concrete-wall, Dec. 5, 2017.

Form Work, http://www.free-ed.net/free-ed/Resources/Trades/carpentry/Building01/default.asp?iNum=0601, Dec. 5, 2017.

* cited by examiner

CONCRETE FORM WITH REMOVABLE SIDEWALL

CROSS REFERENCE TO RELATED APPLICATION

This application is a non-provisional of, and claims priority to, U.S. Provisional Application No. 62/769,109, filed Nov. 19, 2018, which prior application is incorporated by reference herein in its entirety.

FIELD OF THE INVENTION

This disclosure relates to concrete forms, concrete forming assemblies, and methods of forming concrete structures, and more specifically to concrete forms with at least one removable sidewall, as well as concrete forming assemblies and methods utilizing such concrete forms.

BACKGROUND

Insulated concrete forms (ICFs) are often used in the construction of concrete walls and other structures. ICFs typically include a pair of spaced sidewalls fabricated of an insulating material such as expanded polystyrene foam. The sidewalls are connected to each other by cross ties. The cross ties span between the sidewalls and maintain the sidewalls in spaced relationship to define a cavity in between the sidewalls. ICFs are adapted to receive poured concrete in the cavity between the sidewalls. ICFs typically come in modular sizes and are configured to be stacked to create a forming assembly for a concrete wall. The sidewalls are typically left in place after the concrete cures, thereby resulting in a concrete wall with intermediate permanent sidewalls. An example of an ICF wall structure is depicted in U.S. Pat. No. 7,861,479 and example ICF products sold under the brand FOX BLOCKS® are shown and described at www.fox-blocks.com. ICFs typically do not permit removal of either of the sidewalls to expose the surface of the concrete after the concrete structure has been formed. Accordingly, while certain existing concrete forms have a number of advantageous features, they nevertheless have certain limitations. The present disclosure seeks to overcome certain of these limitations and other drawbacks of the prior art, and to provide new features not heretofore available.

BRIEF SUMMARY

Aspects of the disclosure relate to a concrete form that includes a first sidewall and a second sidewall positioned in parallel and spaced relation to each other, the first sidewall has a first passage extending therethrough, with a first insert received in the first passage of the first sidewall, and a first cross tie having opposed first and second ends, where the first sidewall is removably secured to the first end of the first cross tie and the second sidewall is secured to the second end of the first cross tie. A first fastener extends through the first passage and engages the first insert and the first end of the first cross tie to removably secure the first sidewall to the first cross tie. The second sidewall may be removably or non-removably secured to the first cross tie.

According to one aspect, the concrete form further includes a first spacer positioned between the first sidewall and the first end of the first cross tie such that the first sidewall does not contact the first cross tie. In one configuration, the first spacer is aligned with the first insert, and the first insert engages the first spacer. In another configuration, the first insert receives a portion of the first spacer. In a further configuration, the first spacer includes a spacer body having a first side engaging the first sidewall, a second side opposite the first side, and a dowel portion extending outward from the first side of the spacer body, such that the first insert receives the dowel portion. In this configuration, the second side of the spacer body of the first spacer may engages the first end of the first cross tie, and the first side of the spacer body may be circular and may engage the first sidewall around the dowel portion. Further, the first cross tie may include a cross tie body and a mounting body connected to the cross tie body at the first end of the first cross tie, and the first fastener and the second side of the spacer body may engage the mounting body at the first end of the first cross tie.

According to another aspect, the first insert includes a first portion, a second portion having a smaller width than the first portion, and a shoulder portion extending transversely between the first and second portions, and the fastener has an enlarged portion engaging the shoulder portion. In one configuration, the first passage includes a first passage portion located proximate an outer surface of the first sidewall and having a first width, a second passage portion located proximate an inner surface of the first sidewall and having a second width that is smaller than the first width, and a shoulder passage portion extending between the first and second passage portions and transverse to the first and second passage portions. In this configuration the first portion of the first insert is received in the first passage portion, and the second portion of the second insert is received in the second passage portion.

According to a further aspect, the first sidewall has a second passage extending therethrough, and the concrete form further includes a second insert received in the second passage of the first sidewall and a second fastener extending through the second passage and engaging the second insert the first end of the first cross tie to removably secure the first sidewall to the first cross tie. The concrete form further includes a base member embedded within the first sidewall and connected to the first insert and the second insert, such that the base member extends from the first insert to the second insert through the first sidewall.

According to yet another aspect, the first insert is a tubular structure that fits tightly within the first passage.

According to a still further aspect, the first sidewall has a plurality of passages extending therethrough including the first passage, and the concrete form further includes a plurality of inserts, including the first insert, received in the plurality of passages of the first sidewall, and a plurality of cross ties, including the first cross tie, each having opposed first and second ends, where the first sidewall is removably secured to the first ends of the plurality of cross ties and the second sidewall is secured to the second ends of the plurality of cross ties. A plurality of fasteners, including the first fastener, extend through the plurality of passages and engage the plurality of inserts and the first ends of the plurality of cross ties to removably secure the first sidewall to the cross ties, where at least one of the plurality of fasteners engages the first end of each of the plurality of cross ties.

Additional aspects of the disclosure relate to a concrete form that includes a first sidewall and a second sidewall positioned in parallel and spaced relation to each other, and a first cross tie having opposed first and second ends, where the first sidewall is removably secured to the first end of the first cross tie and the second sidewall is secured to the second end of the first cross tie. The first cross tie further includes a cross tie body and a mounting body connected to the cross tie body at the first end of the first cross tie, where the mounting body has a connecting structure including an elongated slot extending vertically and receiving a portion of the cross tie body to connect the mounting body to the cross tie body. A first fastener extends through the first sidewall and engages the mounting body at the first end of the first cross tie to removably secure the first sidewall to the first cross tie.

According to one aspect, the cross tie body includes first and second branches extending laterally between the first and second sidewalls and a bridge extending vertically between the first and second branches at the first end of the first cross tie. In this configuration, the portion of the cross tie body received in the elongated slot of the mounting body is a portion of the bridge.

According to another aspect, the concrete form further includes a plurality of cross ties, including the first cross tie, each having opposed first and second ends, where the first sidewall is removably secured to the first ends of the plurality of cross ties and the second sidewall is secured to the second ends of the plurality of cross ties. Each of the plurality of cross ties further includes a cross tie body and a mounting body connected to the cross tie body at the first end of the cross tie, where the mounting body of each of the plurality of cross ties has a connecting structure including an elongated slot extending vertically and receiving a portion of the cross tie body to connect the mounting body to the cross tie body. A plurality of fasteners, including the first fastener, extend through the first sidewall and engage the mounting bodies at the first ends of the plurality of cross ties to removably secure the first sidewall to the cross ties, where at least one of the plurality of fasteners is connected to each of the plurality of cross ties.

According to one aspect, the mounting body has an engagement surface on an opposite side of the mounting body from the connecting structure, and the first fastener engages the engagement surface of the mounting body.

Aspects of the disclosure also relate to a concrete forming assembly that includes a concrete form as described herein arranged with a plurality of additional concrete forms.

Further aspects of the disclosure relate to a removable sidewall for a concrete form, including a sidewall body having parallel, opposed inner and outer surfaces and a plurality of passages extending through the sidewall body between the inner and outer surfaces and a plurality of insert assemblies connected to the sidewall body. Each insert assembly includes a first insert and a second insert each received in one of the plurality of passages of the sidewall body and a base member embedded within the sidewall body and connected to the first insert and the second insert, such that the base member extends from the first insert to the second insert through the sidewall body.

According to one aspect, each base member extends parallel to the inner and outer surfaces.

According to another aspect, portions of each base member are exposed on a top and a bottom of the sidewall body.

According to a further aspect, the first and second inserts of each of the plurality of insert assemblies is a tubular structure that fits tightly within the respective passage. In one configuration, the first and second inserts of each of the plurality of insert assemblies further includes an end wall exposed on the inner surface of the sidewall body, with an inner opening extending through the end wall.

According to yet another aspect, the first and second inserts of each of the plurality of insert assemblies include a first portion having an outer opening accessible from the outer surface of the sidewall body, a second portion having a smaller width than the first portion, and a shoulder portion extending transversely between the first and second portions.

According to a still further aspect, the sidewall body further includes mating structures on a top and a bottom of the sidewall body configured for stacking the removable sidewall with a second sidewall of a second concrete form.

According to an additional aspect, the plurality of insert assemblies are arranged so that the base members are oriented vertically and are parallel to, and spaced from, each other.

Other aspects of the disclosure relate to a method of forming a concrete structure using a concrete forming assembly that includes a plurality of concrete forms each having a first sidewall and a second sidewall positioned in parallel and spaced relation to each other and a cross tie having opposed first and second ends, where the first sidewall is secured to the first end of the cross tie and the second sidewall is secured to the second end of the cross tie, such that the first and second sidewalls of the plurality of concrete forms combine to define a continuous cavity. The plurality of concrete forms include a first concrete form that has a first passage extending through the first sidewall, a first insert received in the first passage of the first sidewall, and a first fastener extending through the first passage and engaging the first insert and the first end of the cross tie to removably secure the first sidewall to the cross tie. The concrete structure is formed within the continuous cavity by introducing concrete into the continuous cavity and allowing the concrete to solidify. After the concrete has solidified to expose an exterior surface of the concrete structure, the first sidewall is removed.

According to one aspect, the second sidewall is an insulating sidewall and remains in place as insulation after the concrete structure is formed.

According to another aspect, the first concrete form further includes a first spacer positioned between the first sidewall and the first end of the cross tie such that the first sidewall does not contact the cross tie. In one configuration, the first insert includes an inner opening receiving a portion of the first spacer, and the first fastener further engages the first spacer, such that the first spacer is removed with the first sidewall.

Still further aspects of the disclosure relate to a method of assembling a concrete form that uses a first sidewall, a second sidewall, and a first cross tie having opposed first and second ends, where the second sidewall is secured to the second end of the first cross tie. The first sidewall has a first passage extending therethrough and a first insert received in the first passage of the first sidewall, where the first insert has an inner opening accessible from an inner surface of the first sidewall. A portion of a first spacer is inserted into the inner opening of the first insert, such that the first spacer engages the inner surface of the first sidewall. The first sidewall is placed in parallel and spaced relation to the second sidewall, such that the first fastener abuts the first end of the first cross tie and spaces the inner surface of the first sidewall from the first cross tie. A first fastener is then inserted through the first passage and through the first spacer to engage the first end of the first cross tie, where the first fastener engages the first insert, the first spacer, and the first end of the first cross tie to removably secure the first sidewall to the first cross tie.

Other features and advantages of the disclosure will be apparent from the following description taken in conjunction with the attached drawings.

BRIEF DESCRIPTION OF THE DRAWINGS

Further details, aspects, and embodiments of the concrete form of the present disclosure are apparent, by way of example, with reference to the drawings.

DETAILED DESCRIPTION

Figure 1:
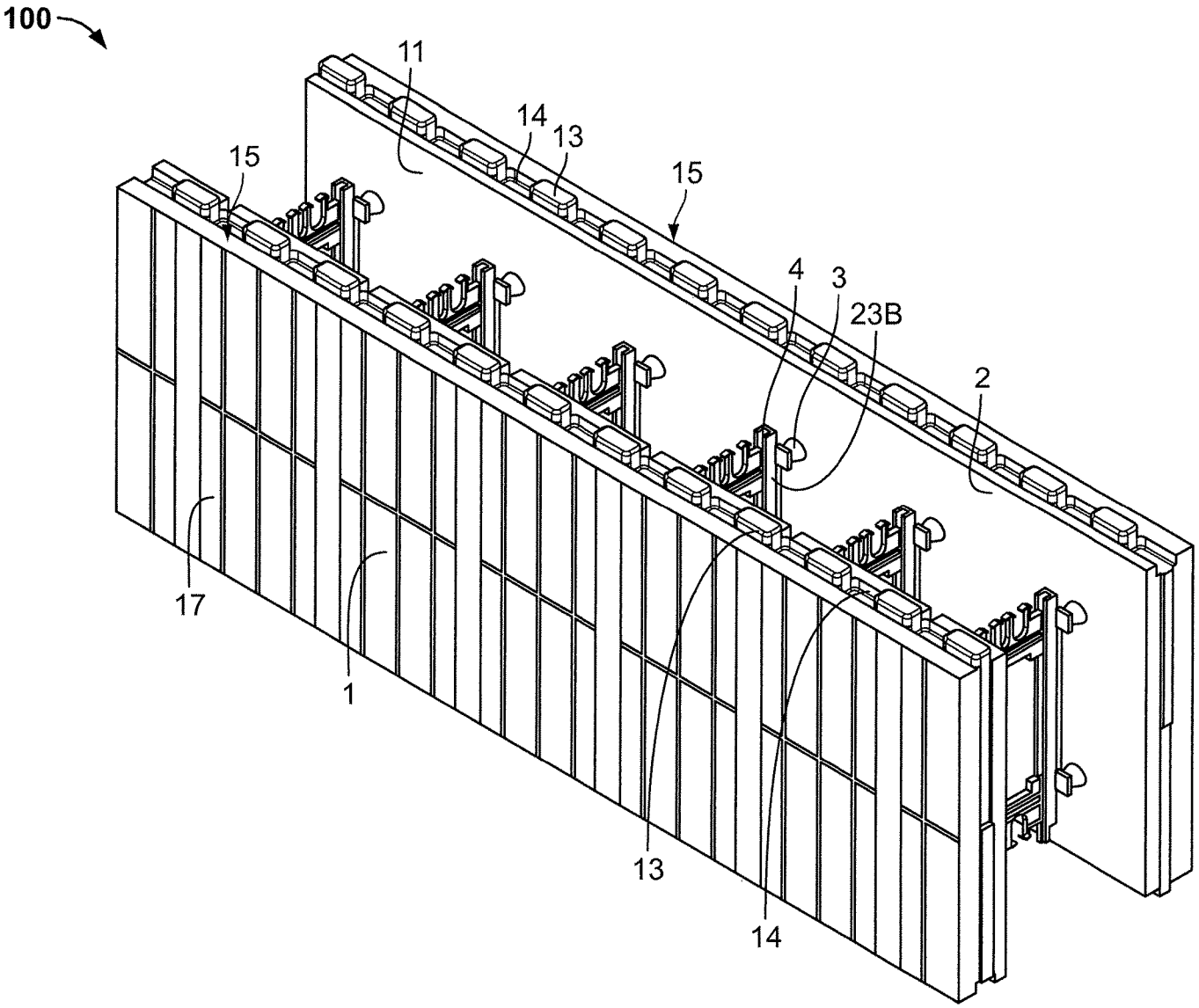
FIG. 1 is a top left perspective view of one embodiment of a concrete form having a single removable sidewall according to aspects of the present disclosure.

While this invention is susceptible of embodiment in many different forms, there are shown in the drawings, and will herein be described in detail, preferred embodiments of the invention with the understanding that the present disclosure is to be considered as an exemplification of the principles of the invention and is not intended to limit the broad aspects of the invention to the embodiments illustrated and described.

Figure 12:
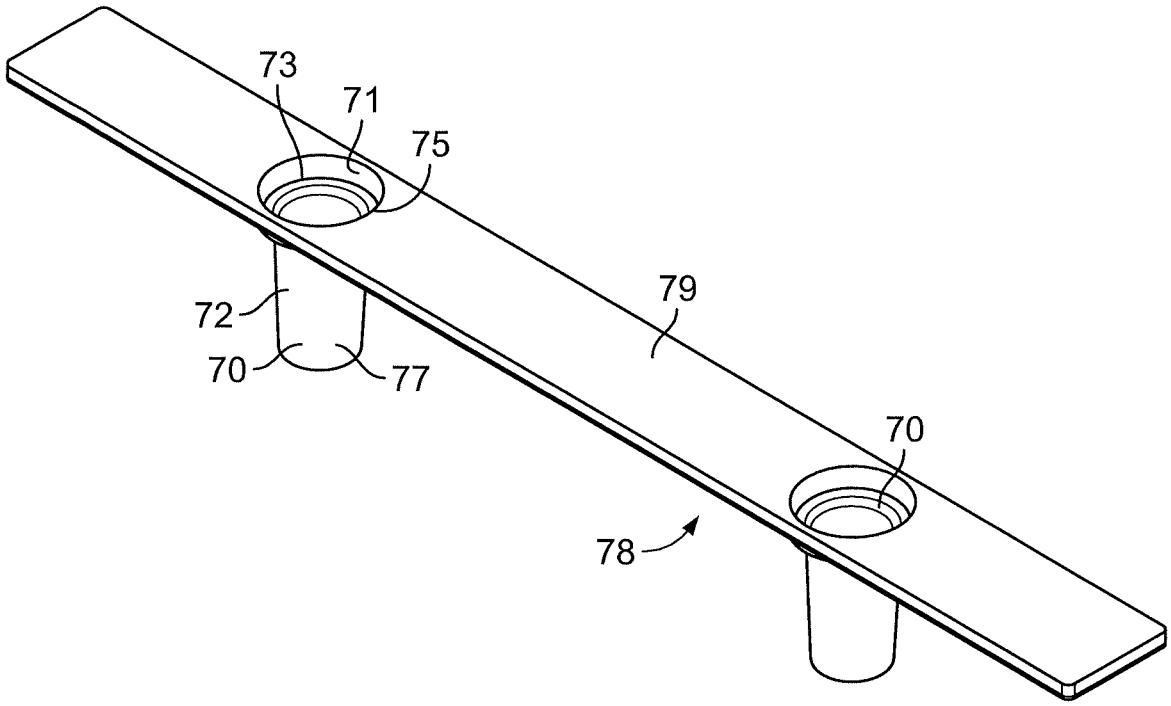
FIG. 12 is a perspective view of the insert assembly of FIG. 11.
Figure 13:
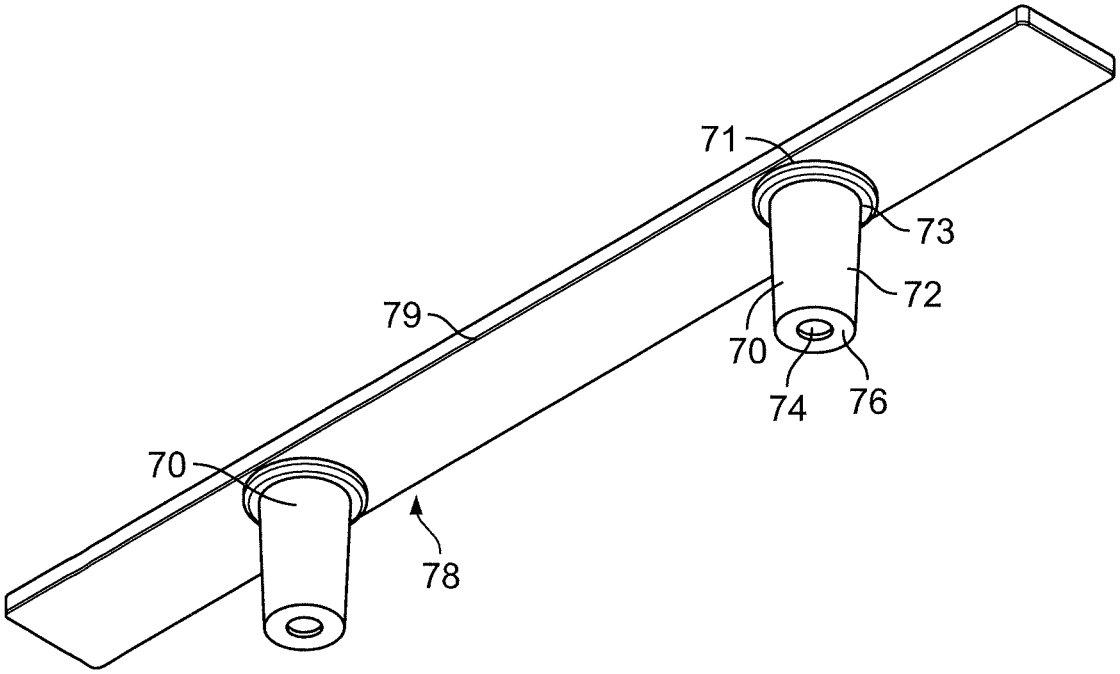
FIG. 13 is a bottom perspective view of the insert assembly of FIG. 11.

The present disclosure relates to concrete forms, concrete forming assemblies constructed using such concrete forms, and methods of assembling concrete forming assemblies and forming concrete walls or other structures using such forms and assemblies. It is understood that while the structures and methods are described herein for forming concrete structures, these structures and methods may be used for forming structures using different materials that can be introduced in a flowable form for later solidification. In general, the concrete forms of the present disclosure have sidewalls that are spaced by one or more cross ties, where at least one of the sidewalls is readily and efficiently removable to expose the exterior surface of the cured/solidified concrete wall within the forms. FIGS. 1-11 depict examples of concrete forms, assemblies, and components thereof, and FIGS. 12-13 depict examples of methods for forming concrete structures that may use such forms, assemblies, and/or components, according to embodiments of the present disclosure. The concrete forms of the present disclosure can be provided as prefabricated forms, such that the individual forms arrive assembled at the job site and/or are made available for sale already assembled. It is understood that connections described or claimed that are not specified as being removable or non-removable may be either removable or non-removable.

In one embodiment shown in FIGS. 1-13, a concrete form 100 includes two sidewalls 1,2 that are spaced from each other and are separated by a plurality of cross ties 4. The sidewalls 1,2 are connected to the ends 23 of the cross ties 4. The sidewalls 1,2 of the concrete form 100 in FIGS. 1-13 include a permanent sidewall 1 constructed of insulating material, which is designed to stay in place as insulation for the resulting concrete structure, and a removable sidewall 2, which is designed to be easily and efficiently removed to expose the surface of the cured/solidified concrete structure. In the embodiment of FIGS. 1-13, both the permanent sidewall 1 and the removable sidewall 2 are constructed of expanded polystyrene foam (EPS) or other insulating material. In other embodiments, either of the sidewalls 1,2 can be constructed of a non-EPS material, e.g. thermoplastic sheet or a wood material (including solid wood, plywood, fiberboard, etc.) in various embodiments, and the materials of the sidewalls 1,2 may be moldable in one embodiment. The permanent sidewall 1 and the removable sidewall 2 may be made of different materials or the same material in various embodiments. It understood that the term "permanent sidewall" means that the sidewall is not removable from the cross tie(s) 4 without damage to one or both components. Generally, the permanent sidewall 1 is intended to remain in place after forming of the concrete structure. In other embodiments, concrete forms 100 according to this disclosure may have a different type of permanent or non-removable sidewall that may not be considered to be "insulating," yet which may be connected to one or more cross ties 4 in a similar manner as the permanent sidewalls 1 described herein. In another embodiment, a concrete form 100 may be constructed using two removable sidewalls 2, including two removable sidewalls that have the same configuration as the removable sidewall 2 in FIGS. 1-13, and the cross ties 4 and other connection structures may be configured for connection to two such removable sidewalls 2. It is understood that the permanent nature of the connection between the cross ties 4 and the permanent sidewall 1 as described herein is not essential, and the permanent sidewall 1 may be replaced with a non-permanently connected sidewall that serves the same function, i.e., remaining in place after forming the concrete structure.

The permanent sidewalls 1 described herein may include mating structures for stacking purposes, such as teeth 13 and recesses 14 arranged in an alternating manner on the top side 15 and the bottom side 16 thereof. In this arrangement, the teeth 13 and recesses 14 on the top side 15 of one permanent sidewall 1 are configured for mating with the teeth 13 and recesses 14 on the bottom side 16 of another permanent sidewall 1 stacked on top of the first permanent sidewall 1. In one embodiment, two permanent sidewalls 1 having substantially the same thickness and positioning of the mating structures 13,14 may be stacked upon each other, and the inner surfaces 11 and the outer surfaces 17 of the two permanent sidewalls 1 will be flush.

The structure of one embodiment of the removable sidewall 2 of the concrete form 100 in FIGS. 1-9 is illustrated in FIGS. 10-13. The removable sidewall 2 described herein may also include mating structures for stacking purposes, and the embodiment in FIGS. 1-9 includes teeth 13 and recesses 14 configured similarly to the teeth 13 and recesses 14 of the permanent sidewall 1. The removable sidewall 2 may also have substantially the same thickness as the permanent sidewall 1. In this configuration, the removable sidewall 2 and the permanent sidewall 1 can be stacked on top of one another with flush inner and outer surfaces 11, 17, if desired. The removable sidewall 2 in FIGS. 1-11 includes a plurality of passages 60 extending through the sidewall 2, from the inner surface 11 to the outer surface 17 and having openings 64,65 on the inner and outer surfaces 11,17, respectively. In this embodiment, the fasteners 26 are inserted through the passages 60 to connect to the spacers 3 and the mounting body 8 of the cross tie 4. Each passage 60 in FIGS. 1-11 has a first portion 61 extending inward from the outer surface 17 of the removable sidewall 2 and a second portion 62 extending inward from the inner surface 11 of the removable sidewall 2, where the first portion 61 has a larger width or diameter than the second portion 62. The first and/or second portions 61,62 of the passage 60 may have constant widths in one embodiment, or may have non-constant widths in another embodiment. For example, the passage 60 in FIGS. 1-9 is configured so that the first portion 61 has a generally constant width and the second portion 62 tapers slightly in width, such that the width of the second portion 62 is greater more proximate to the outer surface 17 and smaller more proximate to the inner surface 11. In such a passage 60 with at least a portion having a non-constant width, the maximum width, the minimum width, and/or the average width of the first portion 61 may be greater than that of the second portion 62. Due to the different widths of the first and second portions 61,62, the outer opening 65 of each passage 60 has a larger width or diameter than the inner opening 64. Each passage 60 in FIGS. 1-11 also has a shoulder portion 63 that is connected to the first and second portions 61,62 and extends transverse to the first and second portions 61,62 as a result of the different widths of the first and second portions 61,62. The surface of the shoulder portion 63 in FIGS. 1-11 extends substantially parallel to the inner and outer surfaces 11,17 of the removable sidewall 2. The passages 60 in FIGS. 1-11, including the first, second, and shoulder portions 61,62,63 thereof, have a circular cross-sectional shape, but it is understood that the passages 60 and/or portions thereof may have different shapes in other embodiments.

Figure 2:
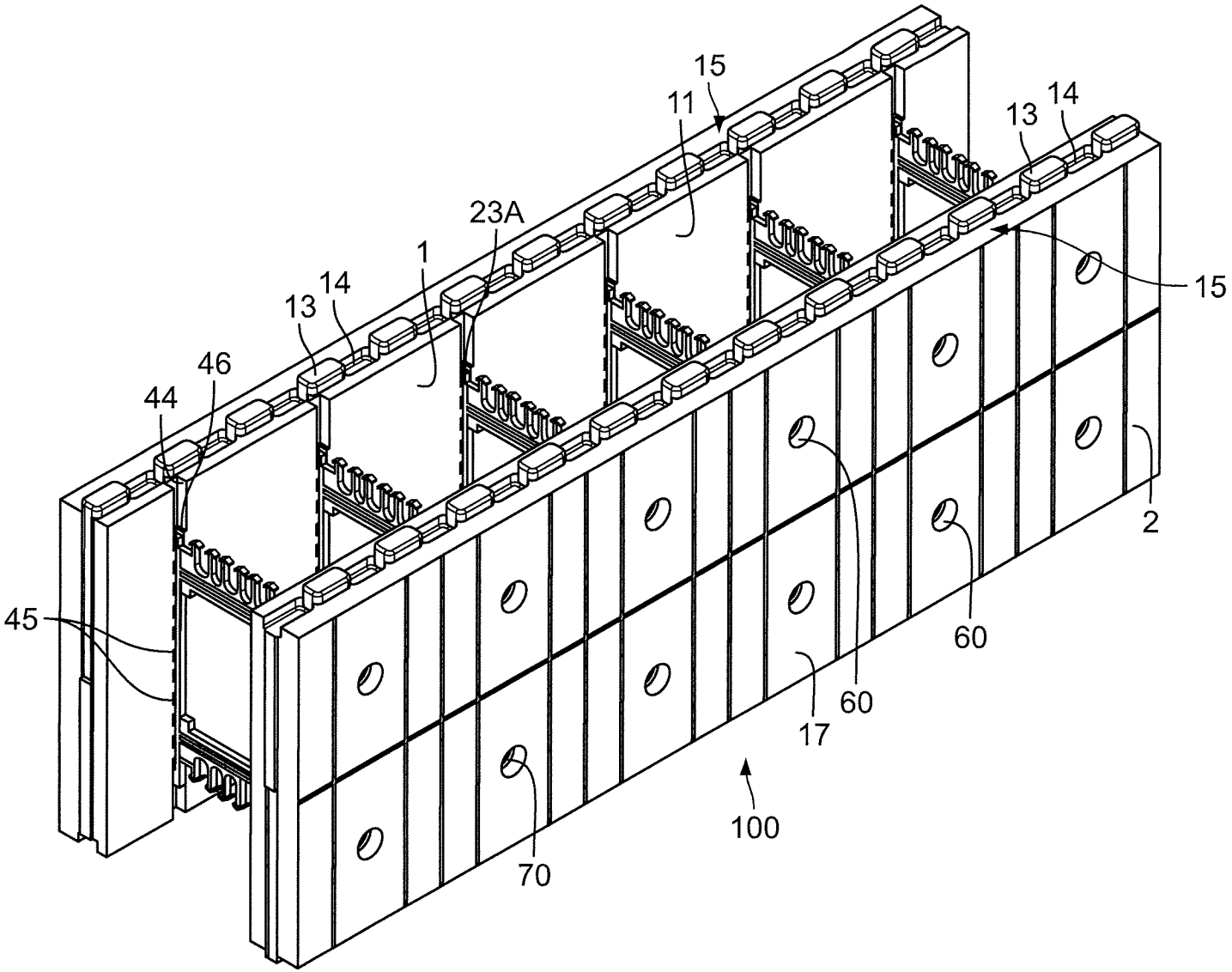
FIG. 2 is a top right perspective view of the concrete form of FIG. 1.
Figure 3:
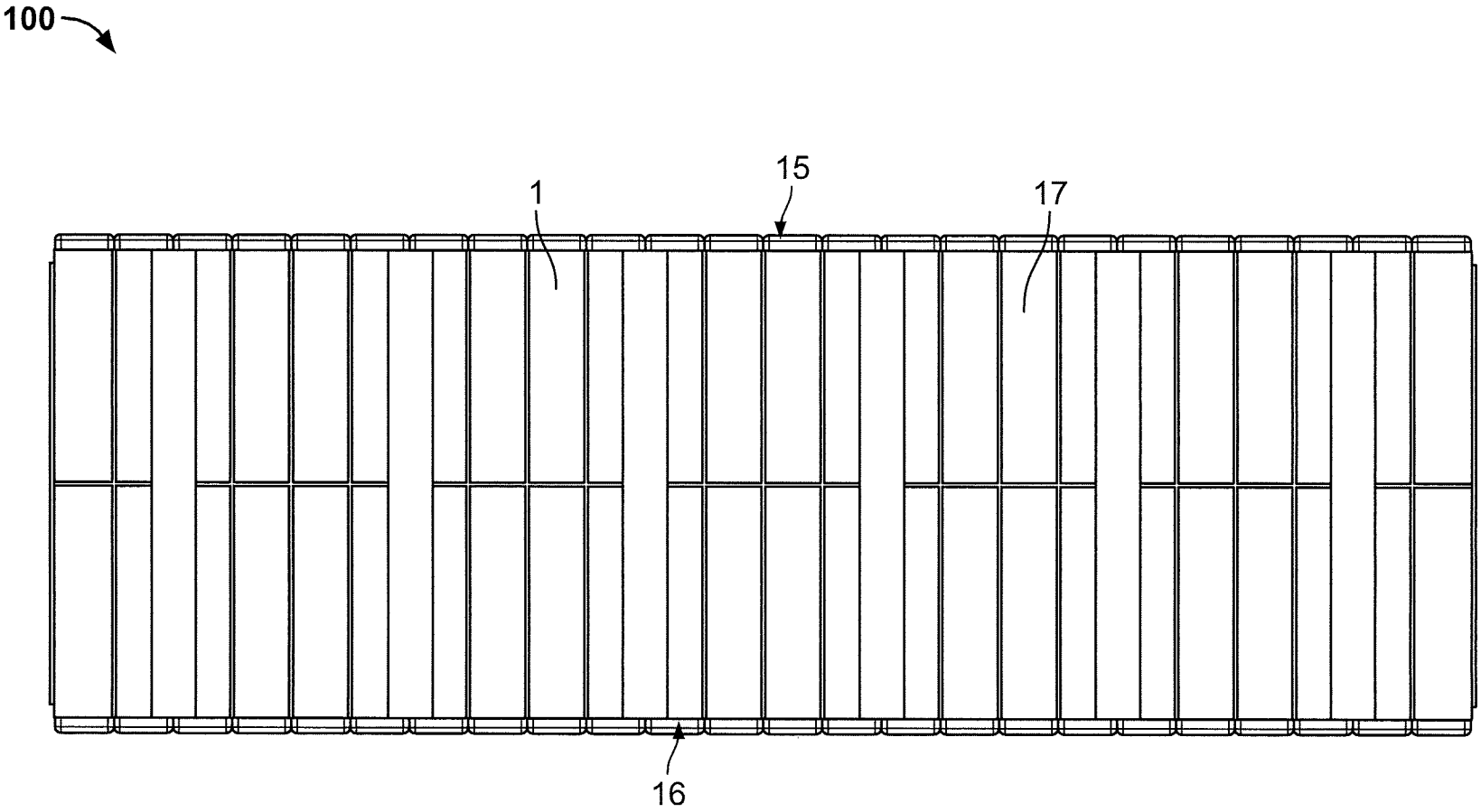
FIG. 3 is a side view of the concrete form of FIG. 1.
Figure 10:
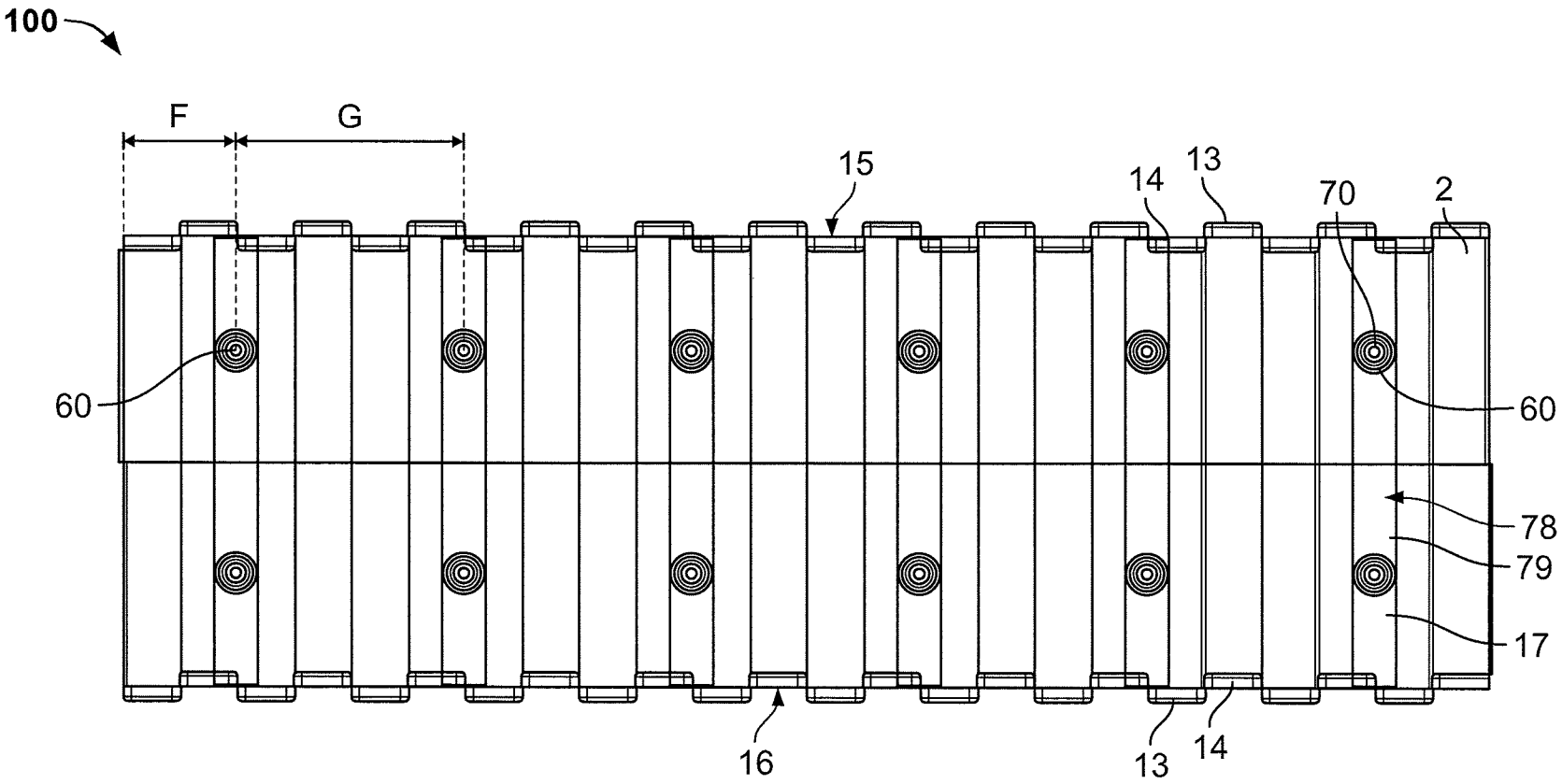
FIG. 10 is a right side view of the removable sidewall of FIG. 1.
Figure 11:
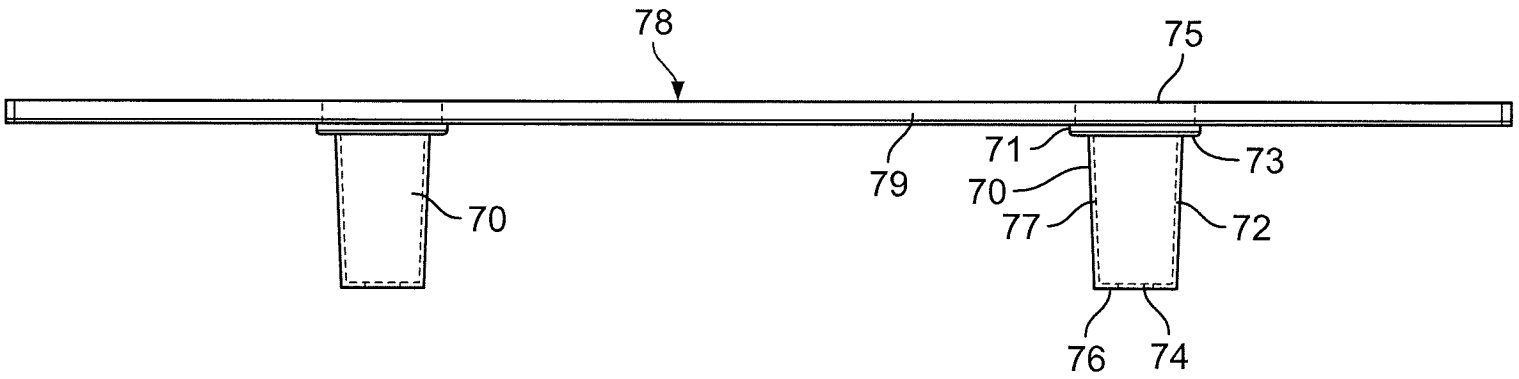
FIG. 11 is a side view of an insert assembly of the removable sidewall of FIG. 10.

The passages 60 in one embodiment are arranged in rows and columns along the length of the removable sidewall 2, as shown in FIGS. 2 and 10-11. In this embodiment, the passages 60 are arranged in upper and lower rows extending lengthwise along the removable sidewall 2, where the passages 60 in each row are spaced at regular intervals with equal spacing, and the passages 60 of the upper and lower rows are vertically aligned. The spacing between the passages 60 is the same as the spacing between the cross ties 4 connected to the permanent sidewall 1, as shown in FIG. 2. In one embodiment, the upper and lower rows of the passages 60 are located equal distances A from the top and bottom sides 15, 16 of the removable sidewall 2, and the spacing B between the upper and lower rows of passages may be approximately 2× (e.g., 1.5-2.5×) the distance A, measured from the centers of the passages 60. For example, in one configuration, the distance A may be 4.0 inches, and the spacing B may be 8.0 inches. Additionally, in one embodiment, the distance F between the end of the removable sidewall 2 and the nearest passages 60 may be approximately 2× (e.g., 1.5-2.5×) the longitudinal spacing G between the passages 60, measured from the centers of the passages 60. For example, in one configuration, the distance F may be 4.0 inches, and the spacing G may be 8.0 inches. Further, in one embodiment, the distances A and F may be approximately equal, and the vertical and longitudinal spacings of the passages 60 may also be approximately equal, such as in the examples described above. In other embodiments, the passages 60 may have a different arrangement, but it is understood that the spacing between the passages 60 may be equal to the spacing between the cross ties 4, to permit use of the passages 60 for connection of fasteners 26 to the cross ties 4.

In one embodiment, the passages 60 each have an insert 70 positioned therein such that the fastener 26 extends through the insert 70, as shown in FIGS. 6-7 and 11-13. The inserts 70 in the embodiment of FIGS. 1-13 are in the form of sleeves or tubular structures defined by a thin wall 77 and which have the same peripheral shapes as the passages 60 in which they are received, and which engage the inner surfaces of the passages 60 in surface-to-surface contact. It is understood that the shapes of the inserts 70 may be configured to fit within and engage the passages 60. The inserts 70 in FIGS. 1-13 each have a first portion 71 positioned within the first portion 61 of the passage 60 and a second portion 72 positioned within the second portion 62 of the passage 60, where the first portion 71 has a greater width or diameter than the second portion 72, as similarly described herein with respect to the shapes of the passages 60. Similar to the passages 60, the inserts 70 in FIGS. 1-13 also each have a shoulder portion 73 that is connected to the first and second portions 71,72 and extends transverse to the first and second portions 71,72, as a result of the different widths of the first and second portions 71,72. The shoulder portion 73 of each insert 70 in FIGS. 1-13 extends substantially parallel to the inner and outer surfaces 11,17 of the removable sidewall 2 and extends along the shoulder portion 63 of the passage 60 in which the insert 70 is received. The first portion 71 of the insert 70 in FIGS. 1-13 has a generally constant width, and the second portion 72 has a tapered width, similar to the structure described herein with respect to the passages 60. Consequently, the first portion 71 of the insert 70 in this configuration has a generally cylindrical shape, and the second portion 72 has a frusto-conical shape.

Each insert 70 in FIGS. 1-13 also has an inner opening 74 in communication with the inner opening 64 of the passage 60 and an outer opening 75 in communication with the outer opening 65 of the passage 60. The outer opening 75 in FIGS. 1-13 is defined by the outer end of the wall 77 at the widest portion of the insert 70, and in this configuration, the end of the wall 77 may be recessed inwardly from the outer surface 17 of the removable sidewall 2. The passage 60 and the insert 70 may be configured so that the outer opening 65 of the passage 60 and the outer opening 75 of the insert 70 have approximately the same inner diameter C (see FIG. 7), such that the inner surfaces of the first portion 61 of the passage 60 and the first portion 71 of the insert 70 are substantially flush. To create this configuration, the first portion 61 of the passage 60 may include an annular recess 67 that receives the first portion 71 of the insert 70, as seen in FIG. 7. The inner diameter or width C of the outer openings 65, 75 of the passage 60 and the insert 70 may be approximately 1.3 inch in one embodiment. The inner opening 74 in FIGS. 1-13 is defined through an end wall 76 of the insert 70 that extends transversely inward from the second portion 72 at the inner end of the insert 70. In this configuration, the inner opening 74 has a width that is smaller than the width of the outer opening 75 and smaller than the minimum widths of the first and second portions 71,72.

In one embodiment, the inserts 70 are formed as one or more insert assemblies 78 having multiple inserts 70 with a base member or web member 79 connecting the inserts 70 and extending between the inserts 70. The removable sidewall 2 in the embodiment of FIGS. 1-13 includes a plurality of insert assemblies 78, each having two inserts 70 connected to a base member 79, and the insert assemblies 78 are positioned vertically with respect to the removable sidewall 2 such that the two inserts 70 of each insert assembly 78 are respectively received in the upper and lower rows of passages 60 in the sidewall 2, as illustrated in FIGS. 6 and 10-13. The edges of the base member 79 of each insert assembly 78 is generally shown in broken lines in FIG. 10. In this configuration, the base member 79 of the insert assembly 78 is connected to the first portion 71 of each insert 70 at or near the outer end of the wall 77, such that the inserts 70 extend in only one direction from the base member 79, as shown in FIGS. 6 and 11-13. Additionally, the base member 79 in the embodiment of FIGS. 6 and 11-13 is a rectangular plate that extends between the inserts 70 and also outwardly beyond the inserts 70, i.e., vertically above and below the inserts 70 in the orientation of FIG. 6. The base member 79 in this configuration is also slightly wider than the inserts 70 and extends on the sides of each insert 70 as well. The base member 79 may be at least partially embedded within the removable sidewall 2, as shown in FIG. 6, and in one embodiment, the sidewall 2 may be molded around the insert assemblies 78. The insert assemblies 78 in FIGS. 1-13 are embedded within the removable sidewall 2 and oriented vertically, such that the ends of the base members 79 are located at or near the top side 15 and the bottom side 16 of the removable sidewall 2 and may be exposed at the top and/or bottom side 15,16. In another embodiment, one or more insert assemblies 78 may be provided with a greater number of inserts 70 on each insert assembly 78, such as a portion or an entire horizontal row of inserts 70, or a two-dimensionally extending arrangement of inserts 70. In a further embodiment, some or all of the inserts 70 may be separate from all other inserts.

The concrete forms 100 generally include one or more cross ties 4 connected to and separating the sidewalls 1,2. The concrete forms 100 in the embodiments of FIGS. 1-9 have a plurality of cross ties 4 arranged in parallel at regular spaced intervals between the sidewalls 1,2. The cross tie 4 in the embodiment of FIGS. 1-9 has opposed ends 23, and the sidewalls 1,2 are directly or indirectly connected to the ends 23 of the cross ties 4. The opposed ends 23 in FIGS. 1-9 include a first end 23A connected to the permanent sidewall 1 and a second end 23B connected to the removable sidewall 2. The cross tie 4 as shown in FIGS. 1-9 has multiple parallel branches 24 that extend between the sidewalls 1,2, and one or more bridges or web members 25 that connect the branches 24 to form a unitary, multi-branched cross tie 4. The cross tie 4 in FIGS. 1-9 has bridges 25 located at both ends 23 that extend between the branches 24. The bridges 25 at the first ends 23A of the cross ties 4 as shown in FIGS. 2 and 5 are at least partially received in slots 44 in the inner surface 11 of the permanent sidewall 1, and the slots 44 may include retaining structure to retain the first ends 23A within the slots 44. For example, the slots 44 in FIGS. 2 and 5 each include a plurality of notches 45 along the length of the slot that are engaged by ridges, teeth, or other locking structures along the bridge 25 to lock the cross tie 4 in place within the slot 44. In this configuration, the top of the first end 23A of the cross tie 4 can be inserted into the slot 44 from the bottom side 16 of the permanent sidewall 1, and the locking structures retain the cross tie 4 in place after insertion. The slot 44 may also have a stop 46 to engage the top end of the cross tie 4 to limit further insertion, as shown in FIG. 2. In one embodiment, the entire cross tie 4, including the branches 24, the bridges 25, and the fingers 27, is made of a single piece, such as by molding. The body of the cross tie 4 is generally symmetrical in FIGS. 1-9 when viewed from the front end parallel to the sidewalls 1,2 (see FIGS. 4 and 6).

FIG. 6 illustrates an alternate embodiment where the first end 23A of the cross tie 4 has an anchor 43 that is embedded within the permanent sidewall 1 and configured to connect the cross tie 4 to the permanent sidewall 1. In this embodiment, the anchor 43 of each cross tie 4 is connected to the bridge 25 at the first end 23A and extends into the body of the permanent sidewall 1, and the anchor 43 may be formed as part of the single piece with the rest of the cross tie 4. It is understood that all other features of FIG. 6 are the same as the features described herein with respect to FIGS. 1-5 and 7-23, and FIG. 6 will therefore be described herein as part of a single embodiment with such other figures for all other purposes.

In general, the cross tie 4 is configured so that the end 23B to be connected to the removable sidewall 2 includes a securement structure for such connection. For example, the cross ties 4 in the embodiments of FIGS. 1-9 include one or more mounting bodies 8 connected to the body 4A of the cross tie 4, such that each mounting body 8 can be abutted or otherwise engaged by a spacer 3 positioned for securement of the removable sidewall 2 to the cross tie 4. The mounting body or bodies 8 can be of sufficient thickness to allow for secure embedding of a screw or other fastener 26 within each body 8. The cross tie 4 in FIGS. 1-9 has a single mounting body 8 at the second end 23B that is connected along the bridge 25 and covers some or all of the end 23B of the cross tie 4. This mounting body 8 is configured for engaging upper and lower spacers 3 and for connection to upper and lower fasteners 26 as described further herein. In another embodiment, the second end 23B of the cross tie 4 may have upper and lower mounting bodies 8 each configured for connection to one fastener 26 configured to be engaged by one spacer 3. The mounting body or bodies 8 in one embodiment are each formed of a separate piece from the cross tie 4 and is connected to the end 23B of the cross tie 4, such as by mechanical connections, bonding materials, or a combination thereof. The mounting body 8 in FIGS. 1-9 is separately formed from the cross tie 4 and is formed of a different material from the cross tie 4. In another embodiment, the mounting body 8 may be formed of a single piece with and/or integrally formed as part of the cross tie 4.

Figure 4:
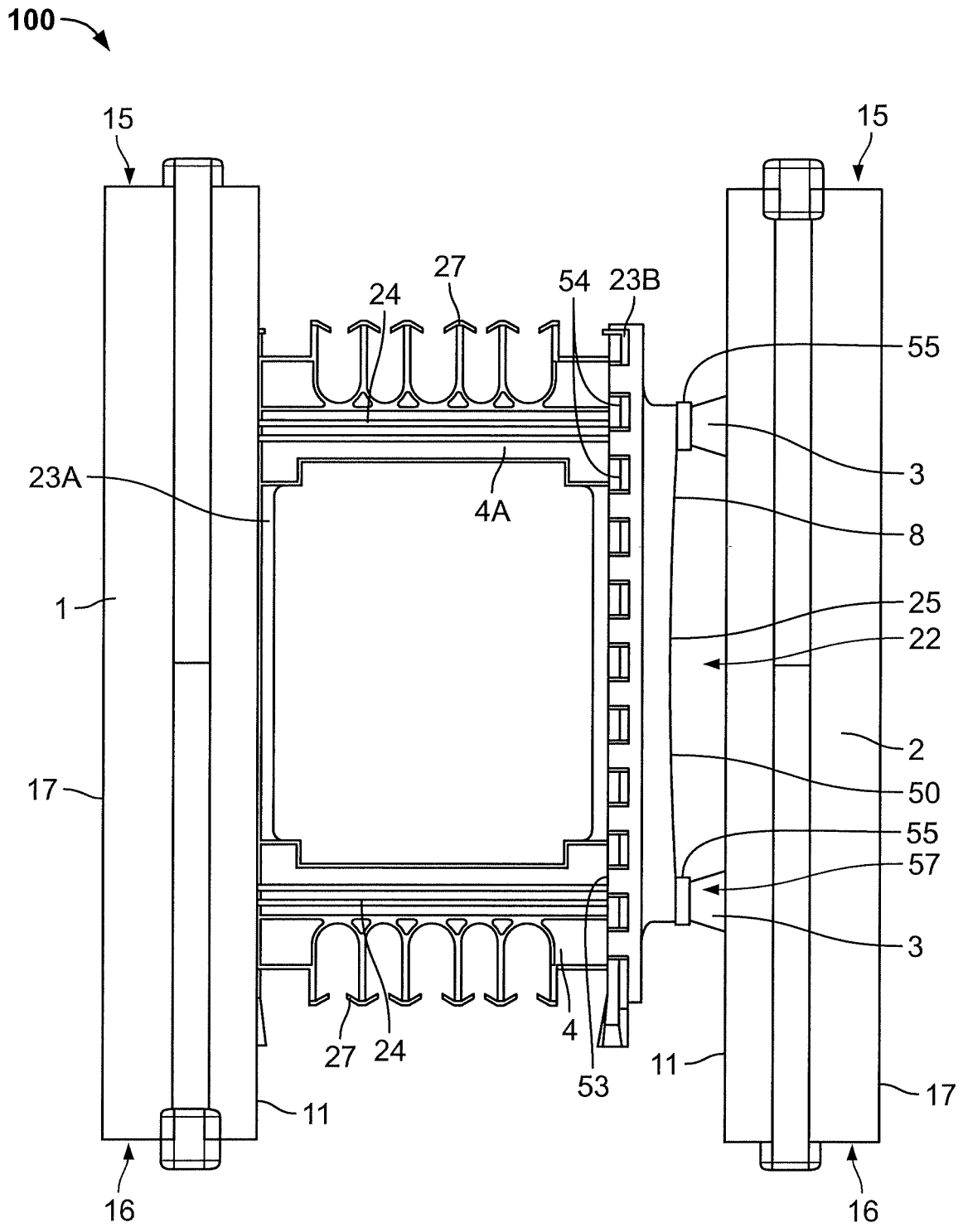
FIG. 4 is a front view of the concrete form of FIG. 1.
Figure 5:
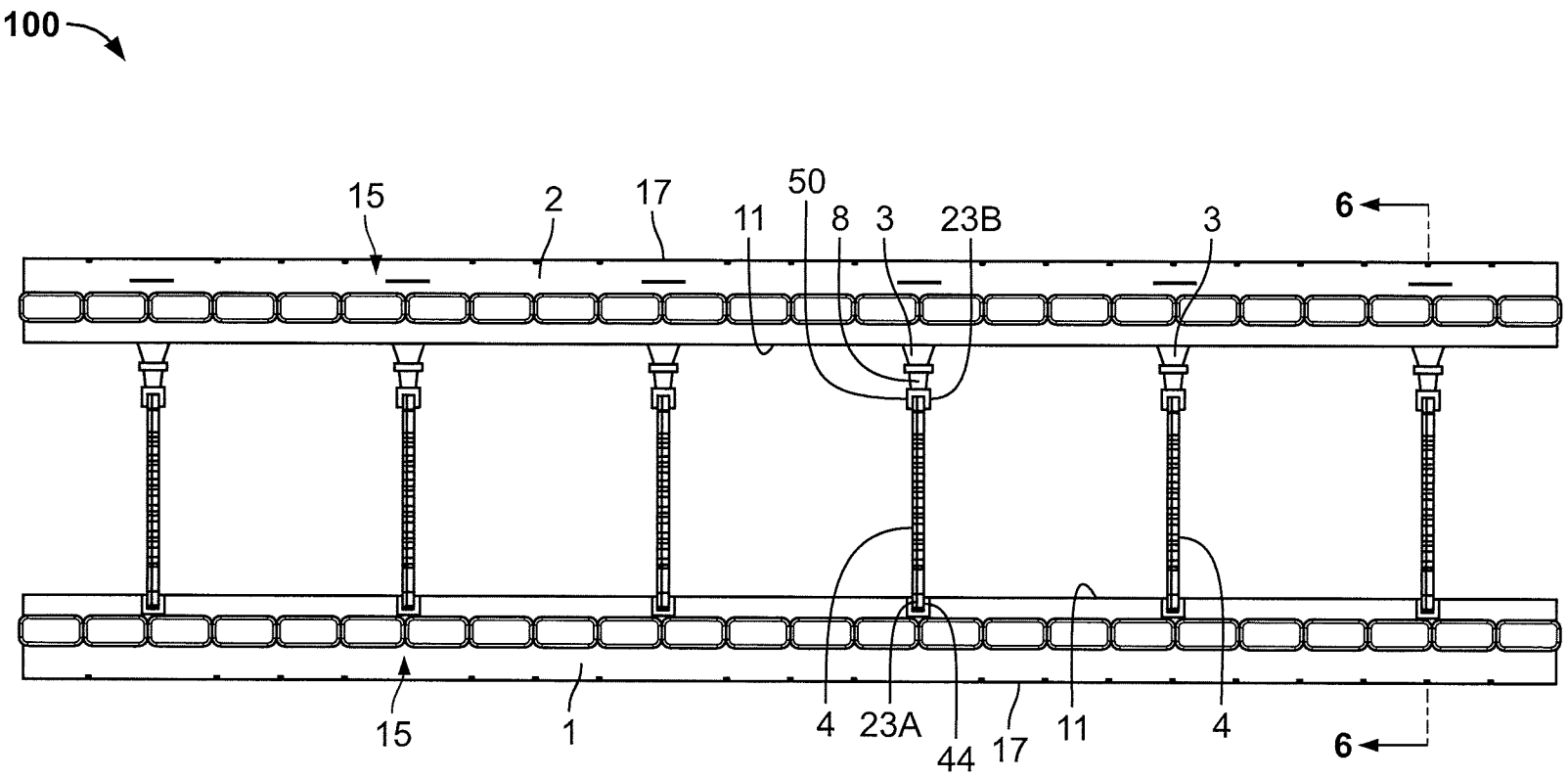
FIG. 5 is a top view of the concrete form of FIG. 1.
Figure 6:
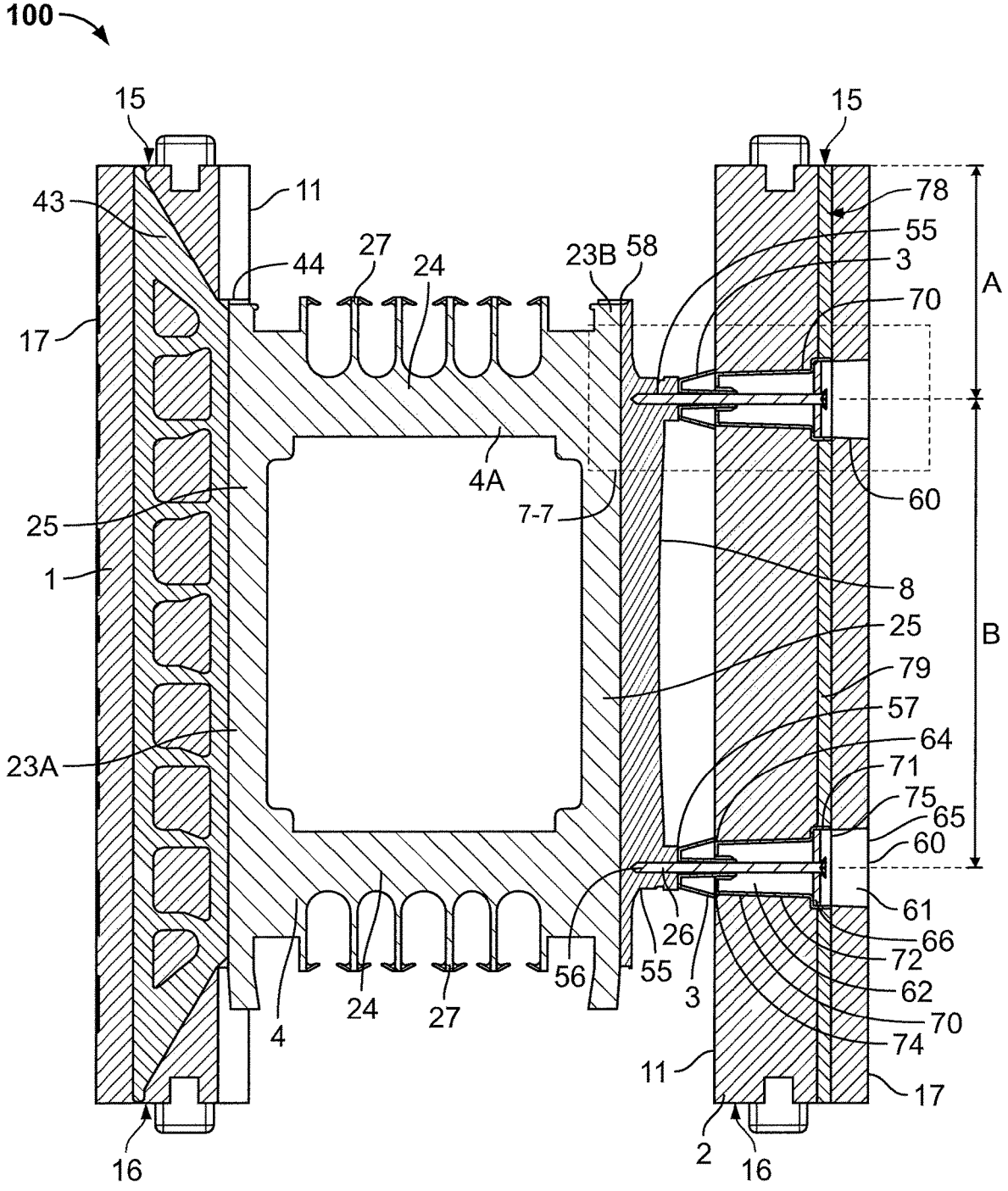
FIG. 6 is a cross-section view taken along line 6-6 in FIG. 5.
Figure 7:
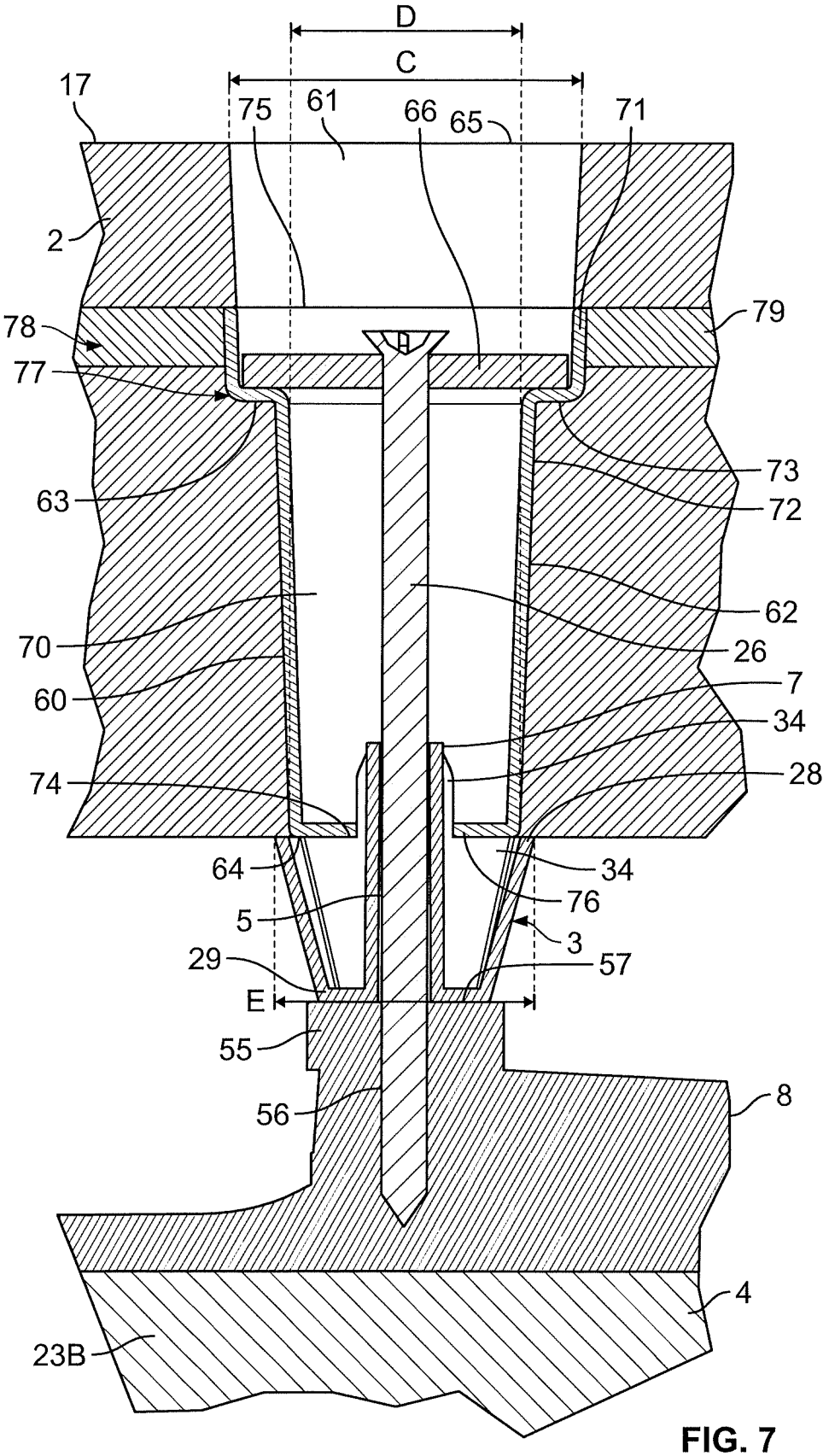
FIG. 7 is a magnified view of area 7-7 in FIG. 6.

The mounting body 8 in FIGS. 1-9 has a connecting structure 50 that includes an elongated slot 51 defined within an elongated C-shaped or U-shaped body 52 that has two walls 53 defining the slot 51 between them. The connecting structure 50 connects to the end 23B of the cross tie body 4A by receiving a portion of the cross tie body 4A in the slot 51 such that the walls 53 engage opposite sides of the cross tie body 4A at the end to secure the end 23B of the cross tie 4 within the slot 51. In FIGS. 1-9, the cross tie body 4A includes the bridges 25 and the branches 24, and a portion of one of the bridges 25 is received in the slot 51. The walls 53 in FIGS. 1-9 have a plurality of notches 54 that are spaced and sequentially positioned along the vertical length of the mounting body 8, as shown in FIG. 4. The notches 54 function similarly to the notches 45 of the slot 44 in the permanent sidewall 1, being engaged by ridges, teeth, or other locking structures along the second end 23B to lock the cross tie 4 in place within the slot 51. The second end 23B of the cross tie 4 can be inserted into the bottom end of the slot 51, and the locking between the locking structures of the second end 23B and the notches 54 retain the second end 23B within the slot 51. The notches 54 are depicted in this embodiment as cut-outs that extend completely through the walls 53, but may be formed by internal recesses on the walls 53 facing into the slot 51. In another embodiment, the locations of the locking structures and the notches 54 may be transposed, such that the locking structures are located within the slot 51 and the notches 54 are located on the cross tie 4. Accordingly, in a general sense, the cross tie 4 and the slot 51 may have complementary locking structures configured to retain the second end 23B of the cross tie 4 within the slot 51. The slot 51 may further have a stop 58 at the top end to engage the top of the second end 23B of the cross tie 4 to limit further insertion. The body 52 having the slot 51 may be wider (front to rear) than the adjacent portions of the mounting body 8, as shown most clearly in FIGS. 8-9. The connecting structure 50 may also include tabs, flanges, or other retaining structure extending inwardly from the walls 53 and/or into the slot 51 to retain the cross tie 4 within the slot 51 in one embodiment.

Figure 8:
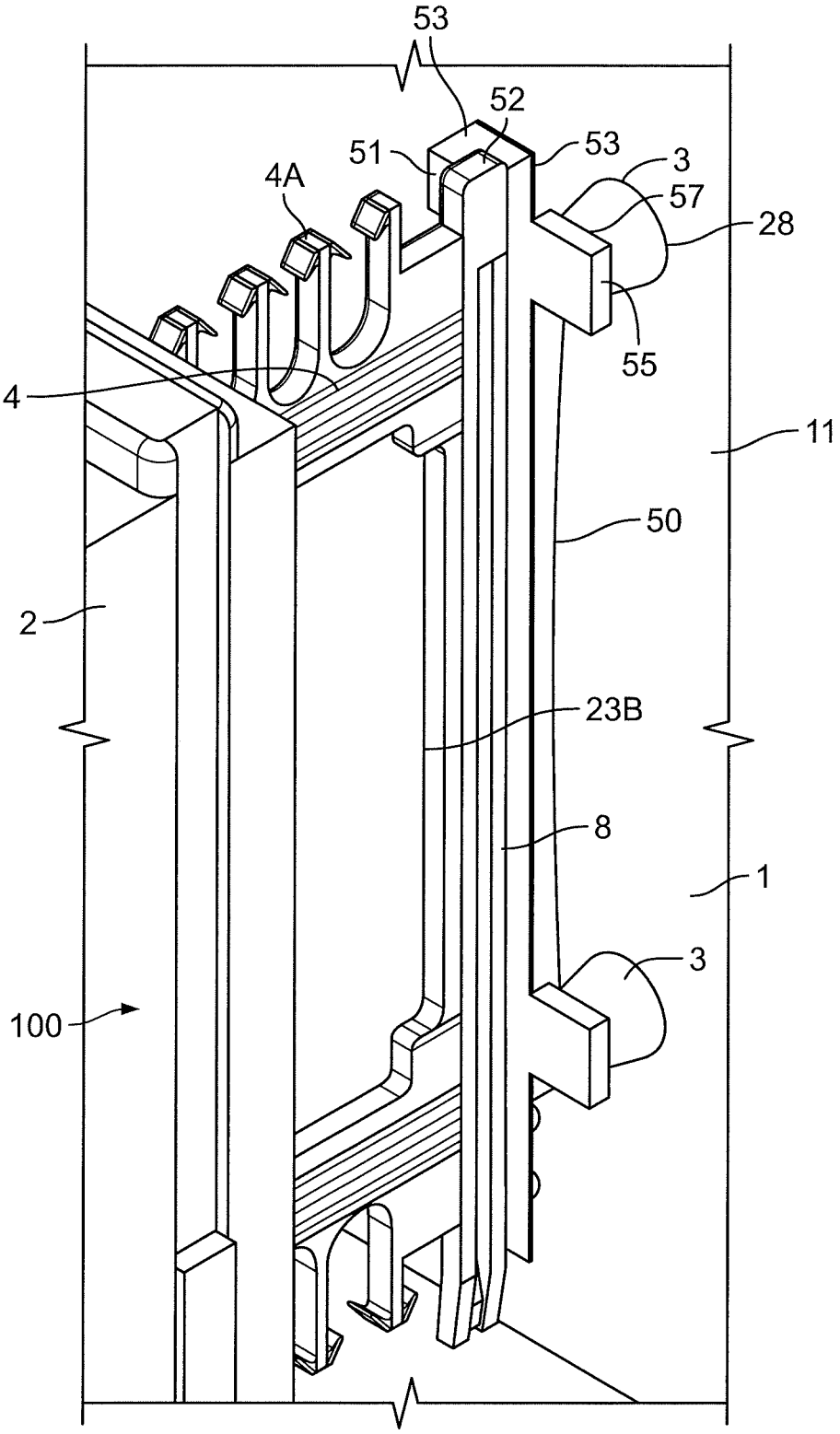
FIG. 8 is a magnified view of a portion of the concrete form of FIG. 1.
Figure 9:
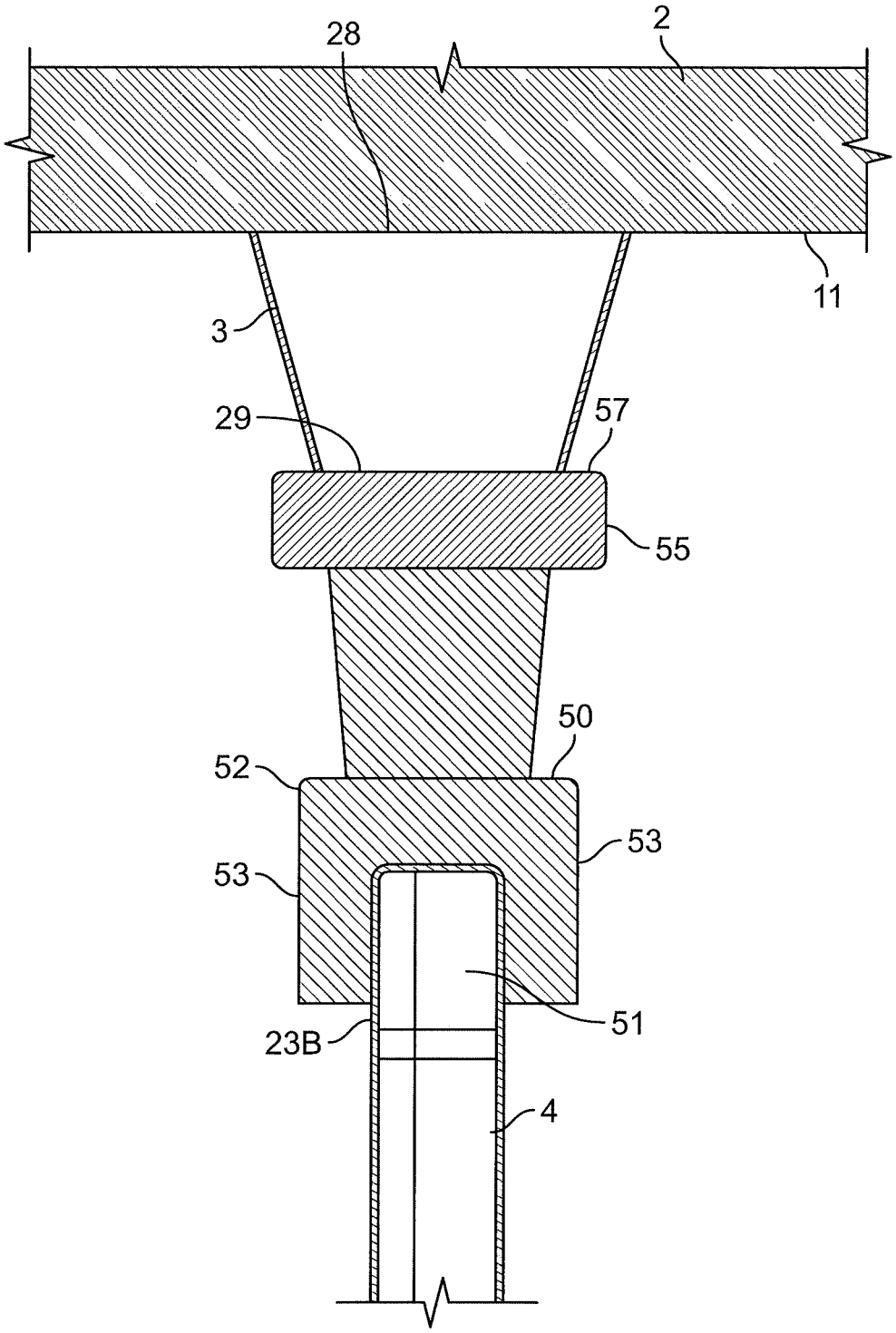
FIG. 9 is a magnified view of a portion of the concrete form of FIG. 5.

The mounting body 8 in FIGS. 1-9 also has an engagement surface 57 on the opposite side from the connecting structure 50 that engages the spacer(s) 3 and the fastener(s) 26 as described herein. The engagement surface 57 in this embodiment includes two projections 55 that extend outward from the side of the mounting body 8, such that the end surfaces of the projections 55 are configured to engage the spacers 3, and the projections 55 create additional material thickness for embedding the fasteners 26 and supporting the connection with the fasteners 26. The spacers 3 engage the mounting body 8 by abutting the projections 55, and the fasteners 26 are connected to the mounting body 8 by embedding within the projections 55, as shown in FIGS. 6-7. The projections 55 in FIGS. 1-9 are in the form of enlarged plates that are wider (front to rear) than the adjacent portions of the mounting body 8, and in one embodiment, are the widest portions of the mounting body 8, as shown in FIGS. 8-9. In another embodiment, the cross tie 4 is configured for connection to two removable sidewalls 2, the cross tie 4 may have mounting bodies 8 on both ends 23 of the cross tie 4.

In the embodiment of FIGS. 1-9, the mounting body 8 has flat surfaces provided by the projections 55, and fasteners 26 in the form of screws or bolts may be inserted into holes 56 in the mounting body 8 that extend into the projections 55. These holes 56 may be formed by pre-forming (e.g., pre-drilling or punching) in one embodiment, or by screwing the fastener 26 directly into the mounting body 8 in another embodiment. In other embodiments, the mounting body 8 may have additional or alternate structures designed for engaging a fastener 26, such as anchor sleeves or other engaging structures within the holes 56, or other structures configured for engaging a different type of fastener 26. The cross ties 4 in the embodiments of FIGS. 1-9 further include structures to increase surface area engagement with concrete surrounding the cross ties 4 and/or provide greater structural reinforcement, such as fingers 27 protruding from the branch 24, ridges, flanges, and other such structures.

Figure 14:
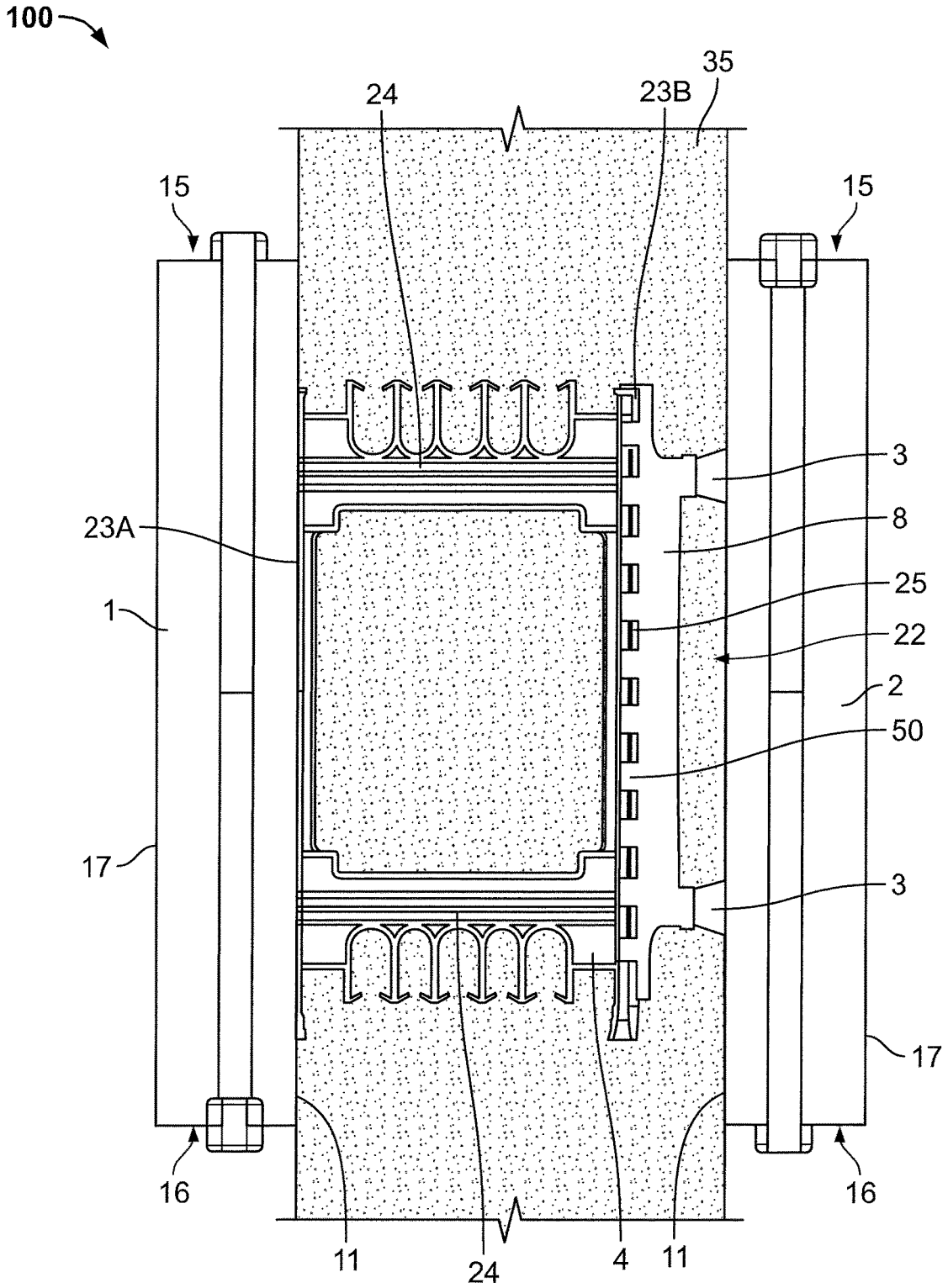
FIG. 14 is a cross-section view showing a concrete structure being created using the concrete form of FIG. 1.
Figure 15:
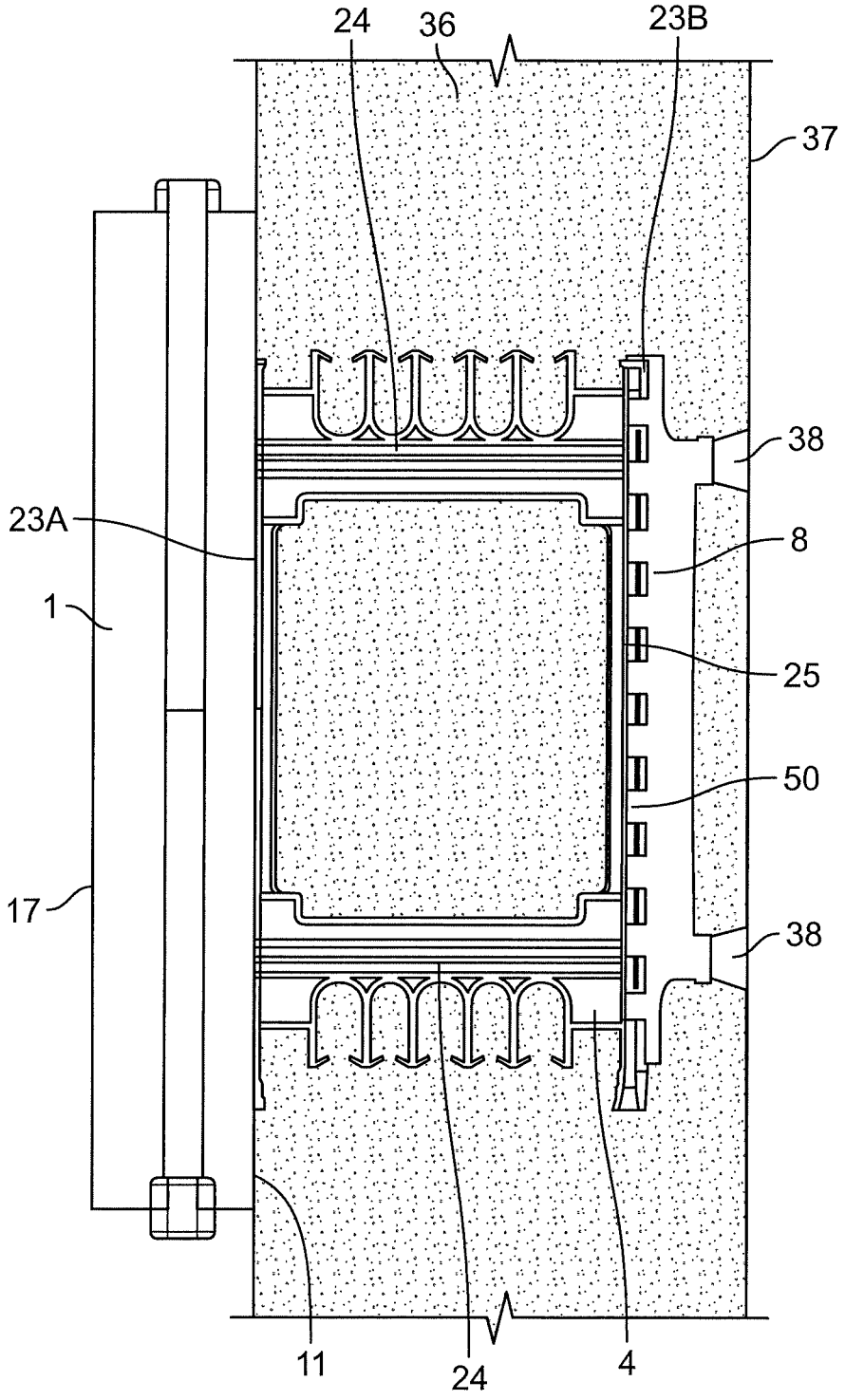
FIG. 15 is a cross-section view showing the concrete structure and concrete form of FIG. 14 after removal of the removable sidewall.
Figure 16:
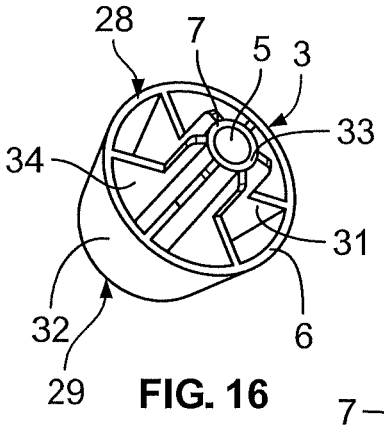
FIGS. 16-18 are perspective views of one embodiment of a spacer according to aspects of the present disclosure.
Figure 19:
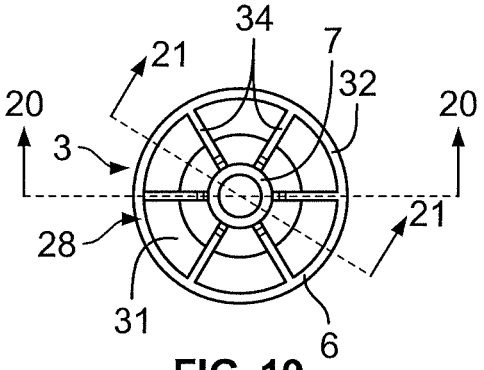
FIG. 19 is a top view of the spacer of FIGS. 16-18.
Figure 17:
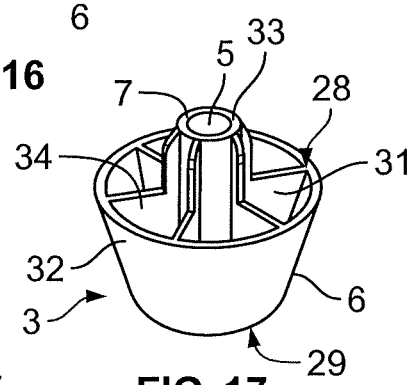
Figure 20:
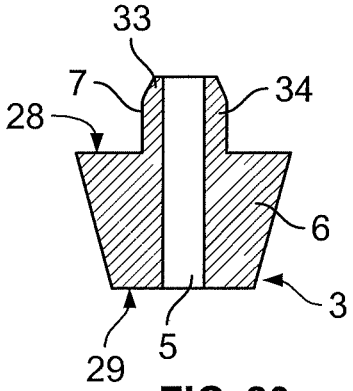
FIG. 20 is a cross-section view taken along lines 20-20 in FIG. 19.
Figure 18:
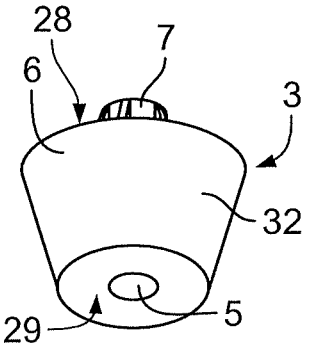
Figure 21:
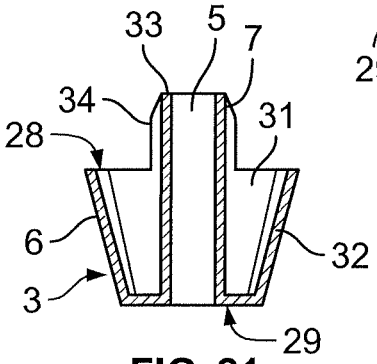
FIG. 21 is a cross-section view taken along lines 21-21 in FIG. 19.
Figure 23:
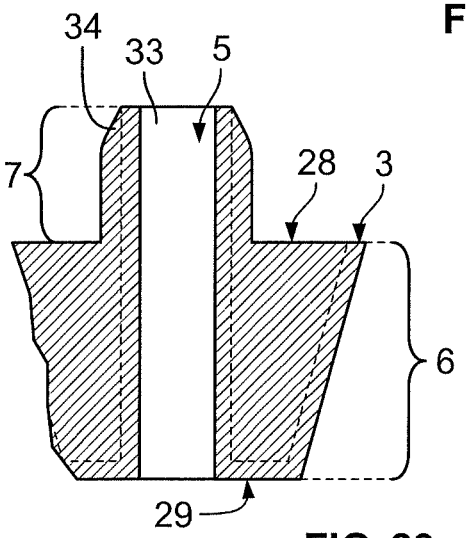
FIG. 23 is an enlarged partial cross sectional view of a portion of the spacer in FIG. 20, with broken lines showing structures hidden from view.
Figure 22:
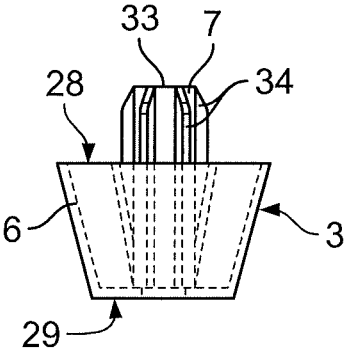
FIG. 22 is a cross-section view taken along lines 22-22 in FIGS. 19.

In one embodiment, the concrete form 100 includes one or more securement spacers 3 positioned in between the removable sidewall 2 and the end 23B of the cross tie 4. The spacers 3 can be configured to separate the cross tie 4 from the removable sidewall 2 such that the removable sidewall 2 does not directly contact the cross tie 4. In this configuration, poured concrete can fill gaps 22 between the removable sidewall 2 and portions of the cross tie 4, as shown in FIG. 14. This allows the end 23 of the cross tie 4 to be embedded within and/or recessed from the exposed surface of the resulting concrete 35 after the removable sidewall 2 is removed, as shown in FIG. 15, creating greater surface uniformity on the exposed surface of the concrete 35 than would otherwise be if the removable sidewall 2 was directly affixed to the cross tie 4. In one embodiment, the spacers 3 are configured to be connected to the removable sidewall 2 and the end 23B of the cross tie 4, such as by a screw or other fastener 26 as described herein, and these connections may be removable or permanent. The spacers 3 may be at least removably connected to the cross tie 4 in one embodiment, permitting the spacers 3 to be removed from the concrete structure with or after removal of the removable sidewall 2. The spacers 3 in this configuration are also formed as separate pieces from the cross tie 4. The spacers 3 may additionally or alternately be removably connected to the removable sidewall 2, and in the embodiments of FIGS. 1-9, the spacers 3 are removably connected to both the removable sidewall 2 and the cross tie 4.

One embodiment of a spacer 3 that is usable in connection with the concrete form 100 is more clearly illustrated in FIGS. 6-9 and is illustrated in greater detail in FIGS. 16-23, and this spacer 3 configuration is generally used in the concrete form 100 in FIGS. 1-9. The spacer embodiments shown and described in U.S. Patent Application Publication No. 2018/0135318, published May 17, 2018, which is incorporated by reference herein, may be used in connection with one embodiment of the concrete form 100 as described herein. The spacer 3 in FIGS. 1-9 and 16-23 includes a body portion or spacer body 6 with a dowel portion 7 projecting outward from the spacer body 6. The spacer body 6 is configured to space the removable sidewall 2 from the cross tie 4 and the dowel portion 7 is configured to extend into the removable sidewall 2. The spacer body 6 in FIGS. 1-9 and 16-23 has two opposed sides 28,29, with one side 28 (which may be referred to as a first side) configured to engage and/or abut the inner surface 11 of the removable sidewall 2 and the opposite side 29 (which may be referred to as a second side) configured to engage and/or abut the mounting body 8. The sides 28,29 of the spacer body 6 in FIGS. 1-9 and 16-23 define planar surfaces that abut planar surfaces of the removable sidewall 2 and the mounting body 8, respectively. The dowel portion 7 projects from the side 28 of the spacer body 6 that abuts the removable sidewall 2. The dowel portion 7 is received within the inner opening 64 of the passage 60 in the removable sidewall 2 and is also received within the inner opening 74 of the insert 70, as shown in FIGS. 6-7. The first side 28 of the spacer body 6 has a width E that is larger than that of the dowel portion 7, and the width E and periphery of the first side 28 of the spacer body 6 are also larger than the width D of the inner openings 64 of the passages 60 of the removable sidewall 2, so the first side 28 can engage the inner surface 11 of the removable sidewall 2 proximate one of the inner openings 64, as shown in FIGS. 7-9. In one embodiment, the width D of the inner opening 64 may be 0.9 inch, and the width E of the first side 28 of the spacer body 6 may be 1.0 inch. The width C of the outer opening 65 may be larger than either or both of the widths D and E, for example 1.3 inch, in one embodiment.

The spacer body 6 in the embodiment of FIGS. 1-9 has a partially hollow construction, with a skirt 32 extending from the second side 29 and surrounding and defining an inner cavity 31, as shown in FIGS. 6-7. It is understood that the spacer body 6 may have a solid construction in other embodiments. In the embodiment of FIGS. 1-9, the dowel portion 7 is affixed to the bottom of the inner cavity 31 of the spacer body 6, on the inner surface of the second side 29, and extends through the inner cavity 31 to project from the first side 28. The spacer 3 may also include ribs 34 within the inner cavity 31 that extend between the skirt 32 and the dowel portion 7, as also shown in FIGS. 6-7. The ribs 34 may be arranged in a symmetrical, radiating configuration with respect to the dowel portion 7, in order to structurally reinforce both the dowel portion 7 and the skirt 32. The ribs 34 in this embodiment form a portion of the first side 28 to abut the inner surface 11 of the removable sidewall 2 and also extend axially on the projecting portion of the dowel portion 7 to define the outer periphery of the dowel portion 7 and engage the inner opening 74 of the insert 70. As shown in FIGS. 6-7, the distal end 33 of the dowel portion 7 has a tapered width, formed by the ribs 34 tapering inward proximate the distal end 33, thereby easing insertion into the inner opening 74 of the insert 70. As shown in FIG. 6, the maximum width of the dowel portion 7 may be approximately equal to the width of the inner opening 74 of the insert 70, such that the outer periphery of the dowel portion 7 (e.g., the ribs 34) tightly engages the inner surfaces of the inner opening 74.

In one embodiment, the spacer and/or the spacer body 6 is configured to have a width that is larger at the first side 28 and smaller at the second side 29, in order to ease removal of the spacer 3 from the solidified concrete structure after forming. In the embodiment of FIGS. 1-9, the spacer body 6 has a frusto-conical shape defined by the skirt 32 that has a circular cross-section and is tapered continuously and linearly outward from the second side 29 to the first side 28. In other embodiments, the width of the spacer body 6 may be varied using a different structure, such as a structure with a curved or stepped contour. Additionally or alternately, the spacer body 6 may have a different external cross-sectional shape (e.g., as defined by the skirt 32), such as a polygonal or irregular shape.

The spacer 3 may further be configured for a specific connection technique, such as connection using a specific fastener 26. The spacer 3 in the embodiment of FIGS. 1-9 includes a throughway or passage 5 defined through the center axis of the spacer 3, such that the fastener 26 in the form of a screw or bolt can pass through the passage 5 to secure the removable sidewall 2, the spacer 3, and the cross tie 4 together. The passage 5 in this embodiment extends from the distal end 33 of the dowel portion 7 along the entire axial length of the dowel portion 7 and the spacer body 6, exiting at the second side 29 of the spacer body 6. In other embodiments, the spacer 3 may be configured for a different connection technique, such as welding, adhesive bonding, or connection using a different type of fastener 26. For example, the spacer 3 may have structures for engaging a different type of fastener 26, such as a passage 5 with internal threading or mating teeth for a ratchet-like engagement, locking or retaining tabs, keyed holes, etc. As another example, the spacer 3 may include multiple passages 5 for multiple fasteners 26. Other structures may be used in other embodiments. In a further embodiment, the concrete form 100 may not use a separate spacer 3, and a portion of the cross tie (e.g., the mounting body 8) may engage the inner surface of the removable sidewall 2 and may function as a spacer, to create a gap 22 between the removable sidewall 2 and the second end 23B of the cross tie 4.

The fasteners 26 in the embodiment of FIGS. 1-13 extend through the passages 60 in the removable sidewall 2, the inserts 70, and the spacers 3 and engage the mounting body 8 of the respective cross tie 4 to connect the removable sidewall 2 to the cross tie 4. The fasteners 26 may each have an enlarged portion 66, such as a washer or an enlarged head, that extends transversely from the fastener 26 to engage the insert 70 and/or the passage 60. In the embodiment of FIGS. 1-13, the enlarged portion 66 of each fastener 26 has a width that is no larger than the width of the first portion 71 of the insert 70 but is larger than the width of the second portion 72 of the insert 70, such that the enlarged portion 66 engages the shoulder portion 73 of the respective insert 70 when the fastener 26 is inserted in the insert 70. The engagement between the enlarged portions 66 and the shoulder portions 73 of the inserts 70 retains the removable sidewall 2 in connection with the cross ties 4. In another embodiment, the removable sidewall 2 may not use inserts 70, and the fastener 26 is configured such that the enlarged portion 66 has a width that is no larger than the width of the first portion 61 of the passage 60 but is larger than the width of the second portion 62 of the passage 60, such that the enlarged portion 66 engages the shoulder portion 63 of the respective passage 60 when the fastener 26 is inserted in the passage 60.

A concrete form 100 according to various embodiments described herein may be assembled by connecting the removable sidewall(s) 2 and spacer(s) 3 to the cross tie(s) 4 in a configuration to permit removal of the removable sidewall(s) 2 and, optionally, the spacer(s) 3 as well. As shown in FIGS. 1-9, the concrete form 100 may include a plurality of cross ties 4 distributed along the length of the concrete form 100, and one or more spacers 3 may be connected between each cross tie 4 and each removable sidewall 2. In the embodiment of FIGS. 1-9, two spacers 3 are connected between each cross tie 4 and the removable sidewall 2, with one spacer 3 located at each branch 24 of the cross tie 4. Generally, each removable sidewall 2 is removably connected to the end 23B of each cross tie 4, and each spacer 3 is connected between the removable sidewall 2 and the cross tie 4, such that the spacer 3 is removable from one or both of the removable sidewall 2 and the cross tie 4. In one embodiment, the spacers 3 are removably connected to the cross tie 4 and are further connected to the removable sidewall 2 in a manner that permits the spacers 3 to be removed from the cross tie 4 simultaneously with removal of the removable sidewall 2, as a single unit. In the embodiments of FIGS. 1-9, the spacers 3 are removably connected to the cross tie 4 and the removable sidewall 2 by a fastener 26 (e.g., a screw or bolt), such that a single fastener 26 connects the spacer 3 to both the cross tie 4 and the removable sidewall 2. The engagement between the dowel portion 7 of the spacer 3 and the removable sidewall 2 also assists in forming this removable connection.

Assembling a concrete form 100 with one permanent sidewall 1 and one removable sidewall 2, such as shown in FIGS. 1-9 generally includes removably connecting the removable sidewall 2 to the cross ties 4. The permanent sidewall 1 may be permanently or removably connected to the cross ties 4 using a variety of techniques, and these components may be connected contemporaneously with connection of the removable sidewall 2 or the cross ties 4 may be connected to the permanent sidewall 1 in a previous step. In one embodiment, the spacers 3 may be connected to the removable sidewall 2 before insertion of the fasteners 26 by insertion of the dowel portions 7 of the spacers 3 into the inner openings 74 of the inserts 70. In this embodiment, the removable sidewall 2 and the spacers 3 can then be connected to the cross ties 4 by positioning the removable sidewall 2 to align the spacers 3 with the connection portions on the ends 23 of the cross ties 4, e.g., the mounting bodies 8. The fasteners 26 can then be inserted through the passages 60 in the removable sidewall 2, the inserts 70, and the passages 5 of the spacers 3 and into the mounting bodies 8 at the second ends 23B of the cross ties 4 to connect the removable sidewall 2 to the cross ties 4 with the spacers 3 separating the removable sidewall 2 from the cross ties 4. If a concrete form 100 is provided with two removable sidewalls 2, assembly of such a form 100 generally includes removably connecting both of the removable sidewalls 2 to opposite ends 23 of the cross ties 4, and the same techniques for connection of the single removable sidewall 2 can be used for connection of the two removable sidewalls 2.

A concrete forming assembly may be constructed of one or more concrete forms 100 according to embodiments shown and described herein. Such a concrete forming assembly may include concrete forms 100 stacked vertically and/or concrete forms 100 placed horizontally adjacent to each other. This assembly of concrete forms 100 may be arranged so that the inner surfaces 11 of all of the sidewalls 1,2 of the concrete forms define a continuous space or cavity 12 configured to receive poured concrete, as shown in FIG. 14. In one embodiment, multiple concrete forms 100 having different combinations of permanent sidewalls 1 and removable sidewalls 2 may be configured for stacking upon each other in a consistent manner to form a stacked assembly of a plurality (i.e., two or more) of concrete forms 100 stacked in a vertical configuration. The permanent and removable sidewalls 1,2 described herein are configured for stacking upon each other in any combination, and thus, concrete forms 100 may be stacked in each stacked assembly in any combination, including forms 100 with two permanent sidewalls 1, two removable sidewalls 2, or a combination of permanent and removable sidewalls 1,2. It is also understood that the assembly may include multiple additional concrete forms 100 placed laterally alongside the stacked concrete forms 100.

In a stacked assembly as described herein, the sidewalls 1,2 all have inner surfaces 11 facing toward the cavity 12 between the sidewalls 1 and/or 2, such that the cross ties 4 extend through the cavity 12 between the sidewalls 1 and/or 2. The sidewalls 1,2 in these assemblies each have an inner surface 11 that is flush with the inner surface 11 of the sidewall 1 and/or 2 stacked on top thereof. In other words, the general plane of the inner surface 11 of the lower sidewall 1,2 and the sidewall 1,2 stacked on top of the lower sidewall 1,2 are aligned with each other. As used herein, two surfaces may be considered to be "flush" and "aligned" if the two surfaces are within ½ inch away from exact alignment in one embodiment, or ¼ inch away from exact alignment in another embodiment, or ⅛ inch away from exact alignment in another embodiment, or 1/16 inch away from exact alignment in a further embodiment. The various sidewalls 1,2 are configured for stacking with each other as described herein to achieve this configuration.

FIGS. 14-15 illustrate one embodiment of a method of forming a concrete structure 36 using a concrete forming assembly that includes a concrete form 100 according to embodiments described herein. In this method, a concrete forming assembly including one or more concrete forms 100 is assembled, which may include assembly of individual concrete forms 100 and/or stacking and alignment of multiple concrete forms 100 to form the assembly. As described herein, some or all of the concrete forms 100 may be provided as prefabricated concrete forms 100 in one embodiment, so that no assembly of the individual concrete forms 100 is necessary. The assembled concrete forming assembly defines a cavity 12 for receiving concrete and forming the concrete structure. The concrete structure can be formed by pouring or otherwise introducing the flowable concrete into the cavity 12 and then allowing the concrete to cure or solidify. FIG. 14 illustrates the concrete form 100 of FIGS. 1-9 with concrete 35 filling the cavity 12 to form a concrete structure 36 in the form of a wall. After the concrete 35 is introduced and solidified, any removable sidewall(s) 2 can be removed from the assembly to expose one or more exterior surfaces 37 of the concrete structure 36. FIG. 15 illustrates the concrete structure 36 and the concrete form 100 of FIGS. 1-9 after removal of the removable sidewall 2 to expose an exterior surface 37 of the concrete structure 36. The spacers 3 may also be removed from the cross ties 4 and the concrete structure 36, and in one embodiment, the spacers 3 may be removed simultaneously with the removable sidewall 2 such that the removable sidewall 2 and some or all of the spacers 3 are removed together as a single unit. In one embodiment, this is accomplished by partially removing the fasteners 26, so that the fasteners 26 disengage or disconnect from the cross ties 4 but are still connected to the spacers 3. When all of the fasteners 26 have been partially removed, the removable sidewall 2 can be removed, and all of the spacers 3 will be pulled away from the concrete structure 36 as part of a single unit with the removable sidewall 2. Removal of the spacers 3 leaves recesses 38 in the exterior surface 37 of the concrete structure 36, with at least a portion of the mounting body 8 exposed within the recesses 38. In one embodiment, these recesses 38 may be filled with a filler material, such as concrete or a concrete filler, thereby leaving a level exterior surface 37. In another embodiment, these recesses 38 may be left open and exposed. The exposed mounting bodies 8 may optionally be used as mounting structures in this configuration, such as by using a fastener to connect a secondary structure to the concrete structure 26. Such a fastener may be configured to engage the hole 56 in the mounting body 8 that was previously engaged by the fastener 26 connecting the spacer 3 and the removable sidewall 2. One example of such a secondary structure is a furring strip, and a wide variety of different wall-mounted structures may be connected to the cross ties 4 in such a configuration. It is understood that some of the recesses 38 may be filled and other recesses 38 may be left exposed in some configurations.

The concrete forms 100, concrete forming assemblies, and methods described herein provide benefits and advantages that are not provided by existing technologies. For example, the use of the spacers 3 as described herein permits the use of a removable sidewall 2 without leaving connecting structures of the concrete form 100 exposed on the surface of the concrete structure 36. As another example, the removable configurations of the spacers 3 as described herein facilitate the removal of the spacers 3, and even permit removal of multiple spacers 3 simultaneously with removal of the removable sidewall 2. As a further example, the relative sizes and dimensions of the insulated sidewalls 1, the removable sidewalls 2, the cross ties 4, and the spacers 3 as described herein permit concrete forms with any combination of insulated sidewalls 1 and removable sidewalls 2 to be stacked on top of each other to form a relatively smooth and seamless concrete structure 36. As another example, the use of the connectable mounting body 8 facilitates assembly of the concrete form 100 in the field, rather than prefabrication, which may be advantageous in some applications. As another example, the use of the inserts 70 facilitates connection of the removable sidewall 2 to the cross tie 4, either in the field or in a manufacturing center. Still other benefits and advantages are provided by the configurations described herein, which would be readily recognizable to those skilled in the art.

Various embodiments of concrete forms, concrete forming assemblies, and components thereof have been described herein, which include various components and features. In other embodiments, the concrete forms, concrete forming assemblies, and components thereof may be provided with any combination of such components and features. It is also understood that in other embodiments, the various devices, components, and features of the concrete forms, concrete forming assemblies, and components thereof described herein may be constructed with similar structural and functional elements having different configurations, including different ornamental appearances.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "top," "bottom," etc., as used herein, are intended for illustrative and reference purposes only and do not limit the embodiments in any way. The term "plurality," as used herein, indicates any number greater than one, either disjunctively or conjunctively, as necessary, up to an infinite number. The term "removable" as used herein refers to two structures that are connected in a way that permits removal or disconnection of one or both components without fracture or other structural damage. "Providing" an article or apparatus, as used herein, refers broadly to making the article available or accessible for future actions to be performed on the article, and does not connote that the party providing the article has manufactured, produced, or supplied the article or that the party providing the article has ownership or control of the article. Accordingly, while specific embodiments have been illustrated and described, numerous modifications come to mind without significantly departing from the spirit of the invention and the scope of protection is only limited by the scope of the accompanying Claims.

What is claimed is:

1. A concrete form comprising:

a first sidewall and a second sidewall positioned in parallel and spaced relation to each other, wherein the first sidewall has an inner surface, an outer surface, and a first passage extending therethrough from the inner surface to the outer surface;

a first insert received in the first passage of the first sidewall, such that the first insert is positioned entirely between the inner surface and the outer surface of the first sidewall;

a first cross tie having opposed first and second ends, wherein the first sidewall is removably secured to the first end of the first cross tie and the second sidewall is secured to the second end of the first cross tie; and a first fastener extending through the first passage and engaging the first insert and the first end of the first cross tie to removably secure the first sidewall to the first cross tie.

2. The concrete form of claim 1, wherein the first sidewall has a second passage extending therethrough, the concrete form further comprising:

a second insert received in the second passage of the first sidewall;

a second fastener extending through the second passage and engaging the second insert the first end of the first cross tie to removably secure the first sidewall to the first cross tie; and a base member embedded within the first sidewall and connected to the first insert and the second insert, such that the base member extends from the first insert to the second insert through the first sidewall.

3. The concrete form of claim 1, wherein the first insert is a tubular structure that fits tightly within the first passage.

4. The concrete form of claim 1, wherein the second sidewall is non-removably secured to the first cross tie.

5. The concrete form of claim 1, wherein the first sidewall has a plurality of passages extending therethrough including the first passage, the concrete form further comprising:

a plurality of inserts, including the first insert, received in the plurality of passages of the first sidewall;

a plurality of cross ties, including the first cross tie, each having opposed first and second ends, wherein the first sidewall is removably secured to the first ends of the plurality of cross ties and the second sidewall is secured to the second ends of the plurality of cross ties; and a plurality of fasteners, including the first fastener, extending through the plurality of passages and engaging the plurality of inserts and the first ends of the plurality of cross ties to removably secure the first sidewall to the cross ties, wherein at least one of the plurality of fasteners engages the first end of each of the plurality of cross ties.

6. The concrete form of claim 1, wherein the first insert has an inner end that is flush with the inner surface of the first sidewall.

7. A concrete form comprising:

a first sidewall and a second sidewall positioned in parallel and spaced relation to each other, wherein the first sidewall has a first passage extending therethrough;

a first insert received in the first passage of the first sidewall;

a first cross tie having opposed first and second ends, wherein the first sidewall is removably secured to the first end of the first cross tie and the second sidewall is secured to the second end of the first cross tie;

a first fastener extending through the first passage and engaging the first insert and the first end of the first cross tie to removably secure the first sidewall to the first cross tie; and a first spacer positioned between the first sidewall and the first end of the first cross tie such that the first sidewall does not contact the first cross tie.

8. The concrete form of claim 7, wherein the first spacer is aligned with the first insert, and the first insert engages the first spacer.

9. The concrete form of claim 8, wherein the first insert receives a portion of the first spacer.

10. The concrete form of claim 8, wherein the first spacer includes a spacer body having a first side engaging the first sidewall, a second side opposite the first side, and a dowel portion extending outward from the first side of the spacer body, and wherein the first insert receives the dowel portion.

11. The concrete form of claim 10, wherein the second side of the spacer body of the first spacer engages the first end of the first cross tie, and the first side of the spacer body is circular and engages the first sidewall around the dowel portion.

12. The concrete form of claim 11, wherein the first cross tie comprises a cross tie body and a mounting body connected to the cross tie body at the first end of the first cross tie, wherein the second side of the spacer body engages the mounting body and the first fastener engages the mounting body at the first end of the first cross tie.

13. A concrete form comprising:

a first sidewall and a second sidewall positioned in parallel and spaced relation to each other, wherein the first sidewall has a first passage extending therethrough;

a first insert received in the first passage of the first sidewall;

a first cross tie having opposed first and second ends, wherein the first sidewall is removably secured to the first end of the first cross tie and the second sidewall is secured to the second end of the first cross tie; and a first fastener extending through the first passage and engaging the first insert and the first end of the first cross tie to removably secure the first sidewall to the first cross tie, wherein the first insert comprises a first portion, a second portion having a smaller width than the first portion, and a shoulder portion extending transversely between the first and second portions, and the first fastener has an enlarged portion engaging the shoulder portion.

14. The concrete form of claim 13, wherein the first passage comprises a first passage portion located proximate an outer surface of the first sidewall and having a first width, a second passage portion located proximate an inner surface of the first sidewall and having a second width that is smaller than the first width, and a shoulder passage portion extending between the first and second passage portions and transverse to the first and second passage portions, wherein the first portion of the first insert is received in the first passage portion, and the second portion of the first insert is received in the second passage portion.

15. A removable sidewall for a concrete form, comprising:

a sidewall body having parallel, opposed inner and outer surfaces and a plurality of passages extending through the sidewall body between the inner and outer surfaces; and a plurality of insert assemblies connected to the sidewall body, each insert assembly comprising a first insert and a second insert each received in one of the plurality of passages of the sidewall body and a base member embedded within the sidewall body and connected to the first insert and the second insert, such that the base member extends from the first insert to the second insert through the sidewall body;

wherein the first and second inserts of each of the plurality of insert assemblies is a tubular structure that fits tightly within the respective passage.

16. The removable sidewall of claim 15, wherein each base member extends parallel to the inner and outer surfaces.

17. The removable sidewall of claim 15, wherein portions of each base member are exposed on a top and a bottom of the sidewall body.

18. The removable sidewall of claim 15, wherein the first and second inserts of each of the plurality of insert assemblies further includes an end wall exposed on the inner surface of the sidewall body, with an inner opening extending through the end wall.

19. The removable sidewall of claim 15, wherein the sidewall body further comprises mating structures on a top and a bottom of the sidewall body configured for stacking the removable sidewall with a second sidewall of a second concrete form.

20. The removable sidewall of claim 15, wherein the plurality of insert assemblies are arranged so that the base members are oriented vertically and are parallel to, and spaced from, each other.

21. A removable sidewall comprising:

a sidewall body having parallel, opposed inner and outer surfaces and a plurality of passages extending through the sidewall body between the inner and outer surfaces; and a plurality of insert assemblies connected to the sidewall body, each insert assembly comprising a first insert and a second insert each received in one of the plurality of passages of the sidewall body and a base member embedded within the sidewall body and connected to the first insert and the second insert, such that the base member extends from the first insert to the second insert through the sidewall body, wherein the first and second inserts of each of the plurality of insert assemblies comprise a first portion having an outer opening accessible from the outer surface of the sidewall body, a second portion having a smaller width than the first portion, and a shoulder portion extending transversely between the first and second portions.

22. A concrete form comprising:

a first sidewall and a second sidewall positioned in parallel and spaced relation to each other;

a first cross tie having opposed first and second ends, wherein the first sidewall is removably secured to the first end of the first cross tie and the second sidewall is secured to the second end of the first cross tie, wherein the first cross tie further comprises a cross tie body and a mounting body connected to the cross tie body at the first end of the first cross tie, wherein the mounting body has a connecting structure comprising an elongated slot extending vertically and receiving a portion of the cross tie body to connect the mounting body to the cross tie body; and a first fastener extending through the first sidewall and engaging the mounting body at the first end of the first cross tie to removably secure the first sidewall to the first cross tie.

23. The concrete form of claim 22, wherein the cross tie body comprises first and second branches extending laterally between the first and second sidewalls and a bridge extending vertically between the first and second branches at the first end of the first cross tie, wherein the portion of the cross tie body received in the elongated slot of the mounting body is a portion of the bridge.

24. The concrete form of claim 22, further comprising:

a plurality of cross ties, including the first cross tie, each having opposed first and second ends, wherein the first sidewall is removably secured to the first ends of the plurality of cross ties and the second sidewall is secured to the second ends of the plurality of cross ties, wherein each of the plurality of cross ties further comprises a cross tie body and a mounting body connected to the cross tie body at the first end of the cross tie, wherein the mounting body of each of the plurality of cross ties has a connecting structure comprising an elongated slot extending vertically and receiving a portion of the cross tie body to connect the mounting body to the cross tie body; and a plurality of fasteners, including the first fastener, extending through the first sidewall and engaging the mounting bodies at the first ends of the plurality of cross ties to removably secure the first sidewall to the cross ties, wherein at least one of the plurality of fasteners is connected to each of the plurality of cross ties.

25. The concrete form of claim 22, wherein the mounting body has an engagement surface on an opposite side of the mounting body from the connecting structure, wherein the first fastener engages the engagement surface of the mounting body.

* * * * *